US007543352B2

(12) United States Patent
Schaaf

(10) Patent No.: US 7,543,352 B2
(45) Date of Patent: Jun. 9, 2009

(54) CLEANING APPARATUS AND RELATED METHODS

(75) Inventor: Philip J. Schaaf, San Francisco, CA (US)

(73) Assignee: Grill Sponge, LLC, San Francisco, CA (US)

( * ) Notice: Subject to any disclaimer, the term of this patent is extended or adjusted under 35 U.S.C. 154(b) by 577 days.

(21) Appl. No.: 10/797,211

(22) Filed: Mar. 10, 2004

(65) Prior Publication Data

US 2004/0226577 A1 Nov. 18, 2004

Related U.S. Application Data

(60) Provisional application No. 60/480,271, filed on Jun. 20, 2003, provisional application No. 60/454,407, filed on Mar. 11, 2003.

(51) Int. Cl.
*A47L 13/16* (2006.01)

(52) U.S. Cl. ..... 15/244.4; 134/6; 15/210.1

(58) Field of Classification Search ..... 15/244.1, 15/244.4, 209.1–210.1; D32/40; D28/63; D4/137; 134/6

See application file for complete search history.

(56) References Cited

U.S. PATENT DOCUMENTS

| | | | | |
|---|---|---|---|---|
| 3,146,479 | A * | 9/1964 | Stoker | 15/118 |
| 3,188,675 | A * | 6/1965 | Beck | 15/244.1 |
| 3,611,468 | A | 10/1971 | Michael | |
| 3,707,012 | A * | 12/1972 | Lane | 15/104.93 |
| 4,055,029 | A | 10/1977 | Kalbow | |
| 4,690,125 | A * | 9/1987 | Beller | 126/25 A |
| 4,866,806 | A | 9/1989 | Bedford | |
| 5,312,197 | A | 5/1994 | Abramson | |
| 5,821,184 | A | 10/1998 | Haines et al. | |
| 5,836,034 | A | 11/1998 | Galvan Garza | |
| 5,972,817 | A | 10/1999 | Haines et al. | |
| 5,987,693 | A | 11/1999 | Noga | |
| 6,276,023 | B1 | 8/2001 | Grundy | |
| 6,663,309 | B2 * | 12/2003 | Zamansky et al. | 401/264 |
| 6,833,033 | B1 * | 12/2004 | Knight | 134/6 |
| 6,916,382 | B1 * | 7/2005 | Aldredge | 134/6 |
| 2001/0029967 | A1 * | 10/2001 | McDonough | 134/6 |

FOREIGN PATENT DOCUMENTS

| | | |
|---|---|---|
| CA | 2023273 | 2/1992 |
| CA | 2144620 | 10/1996 |
| DE | 198 45 312 A1 | 4/2000 |
| EP | 0 458 655 | 11/1991 |
| GB | 1 402 358 | 8/1975 |
| JP | 01284222 | 11/1989 |

(Continued)

OTHER PUBLICATIONS

Reid, Adam, "Do Grill Pans Really Grill?" Feb. 2006, "Cook's Illustrated", p. 28.*

(Continued)

*Primary Examiner*—Laura C Guidotti
(74) *Attorney, Agent, or Firm*—Knobbe Martens Olson & Bear LLP

(57) ABSTRACT

A cleaning apparatus for a contoured cooking surface is disclosed. Methods of cleaning a cooking system with the cleaning apparatus are also disclosed.

21 Claims, 19 Drawing Sheets

FOREIGN PATENT DOCUMENTS

| | | |
|---|---|---|
| WO | WO 97/24053 | 7/1997 |

OTHER PUBLICATIONS

"Flying off the shelves at . . . Curry's", Sep. 28, 2005, "The Guardian".*

"Solutions for Pesky Household Problems", Jun. 9, 2005, "Staten Island Advance", section B2.*

International Search Report for International Application No. PCT/US2004/007248; mailed on Aug. 9, 2004.

* cited by examiner

CLEANING APPARATUS AND RELATED METHODS

CROSS-REFERENCE TO RELATED APPLICATIONS

This application claims priority to U.S. Provisional Application Ser. No. 60/454,407, filed Mar. 11, 2003 and to U.S. Provisional Application Ser. No. 60/480,271, filed Jun. 20, 2003, the disclosures of which are herein incorporated by reference in their entireties.

BACKGROUND OF THE INVENTION

1. Field of the Invention

The present invention relates to a cleaning system, and in particular, devices for cleaning a cooking surface.

2. Description of the Related Art

Many cooking devices have non-planar surfaces that are difficult to clean and maintain in an efficient, safe, and convenient manner. In particular, indoor grills, including two sided models, can be very difficult to clean and maintain. Cleaning and maintenance generally must be done using towels, brushes, and pads that are awkward to use on the surfaces. Many of these are inadequate because they are unable to contact with all parts of the cooking surface and they provide inefficient and unsafe cleaning surfaces. Furthermore, the process of cleaning can be tedious, laborious, lengthy and unproductive. Thus, cleaning and maintaining these cooking devices becomes prohibitive and results in under utilization of the devices. The instant invention overcomes these existing drawbacks.

SUMMARY OF THE INVENTION

Embodiments relate to devices for cleaning a cooking surface. The device can include at least a first cleaning face and a second cleaning face, wherein the second cleaning face is positioned at a cleaning angle with respect to the first cleaning face, and wherein the cleaning angle corresponds to a cooking angle between a first cooking face and second cooking face of the cooking surface to be cleaned by the device. A sum of the cleaning angle and the cooking angle can be, for example, about 180 degrees. Further, in some aspects neither the cleaning angle nor the cooking angle is 90 degrees, for example.

In some embodiments, the cleaning devices can be made of or include bristles, but in preferred embodiments, bristles are explicitly excluded. Also, in some preferred embodiments, if a foam or sponge material is used, it is preferred that such foam or sponge be a strong and resilient material that is suitable for applying pressure in a scrubbing motion. In preferred embodiments, the use of foam matrix or sponge material, such as those used, for example in foam paint brushes, is unsuitable for the cleaning devices. In some preferred embodiments the devices do not include handles, such sticks or pain brush handles.

The device further can include at least a third cleaning face, wherein the third cleaning face is positioned at an angle with respect to the first or second cleaning face. The cleaning faces can combine to form a configuration selected from the group consisting of a ridge, a channel, a groove, and a notch. The device can include for example a material that is non-abrasive to the cooking surface. The material can be, for example, foam, rubber, silicon, a synthetic material, polyester, cellulose, natural sponge, synthetic sponge, plastic, mesh, fiber, nylon, natural bristles, synthetic bristles, an organic polymer, an extrusion, and the like. In other embodiments, where the cooking device surface can withstand it, the material can be, for example, steel wool, composite stone or sands, or other abrasive compounds. The device can include an absorbent material, for example. The material can be infused with a cleaning agent, such as for example, water, soap, detergent, oil based materials, hydrophilic substances, hydrophobic substances, and the like. The device can include a material that is resistant to heat, for example. The device further can include, in preferred embodiments, at least one non-cleaning portion, wherein at least one cleaning face comprises a surface area that is greater than a surface area of the non-cleaning portion.

Further embodiments related to methods of cleaning a cooking surface. The methods can include the steps of providing a cooking surface having at least a first cooking face and a second cooking face, wherein the first cooking faces is positioned at a cooking angle with respect to the second cooking face; providing a cleaning device having at least a first cleaning face and a second cleaning face, wherein the first cleaning face is positioned at a cleaning angle with respect to the second cleaning face; aligning the cleaning device with the cooking surface such that substantially all of the first and second cleaning faces maintain full contact with at least a portion of the first and second cooking faces; and moving the cleaning device in a substantially linear direction against the cooking surface. In other embodiments, the cleaning methods can include providing a cleaning device having at least a first cleaning face and a second cleaning face, wherein the first cleaning face is positioned at a cleaning angle with respect to the second cleaning face, wherein the at least a first cleaning face and the second cleaning face conform to at least a first cooking face and a second cooking face of a cooking device, such that substantially all of the first and second cleaning faces maintain full contact with at least a portion of the first and second cooking faces; and aligning and contacting the cleaning device with the cooking faces of the cleaning device. The sum of the cleaning angle and the cooking angle can be, for example, about 180 degrees. For some cooking devices, the ribs or protrusions vary in height from one of their ends to the other end. Thus, in other embodiments, substantially all of the first and second cleaning faces maintain full contact with at least a portion of the first and second cooking faces at one end or region of the cooking device, while only a part of the of the first and second cleaning faces maintain full contact with at least a portion of the first and second cooking faces at the other end or region of the cooking device. In some embodiments, the device is cylindrical, ovoid, or spherical, and has up to 360° of cleaning surface with grooves or notches. In other embodiments, the methods can include devices with two, three, four or more generally planar cleaning sides, with each side having grooves or notches. In other embodiments, the cleaning devices can include a third, fourth, fifth, etc. cleaning angle. For example a device with a pair of grooves can have six cleaning angles for example.

The cleaning device can employ, for example, a material that is non-abrasive to the cooking surface. The material can be, for example, foam, rubber, silicon, a synthetic material, polyester, cellulose, natural sponge, synthetic sponge, plastic, mesh, fiber, nylon, natural bristles, synthetic bristles, an organic polymer, an extrusion, and the like. The device can include an absorbent material, for example. The material can be infused with a cleaning agent, such as for example, water, soap, detergent, oil based materials, hydrophilic substances, hydrophobic substances, and the like. The device can include a material that is resistant to heat, for example. The device further can include at least one non-cleaning portion, wherein at least one cleaning face comprises a surface area that is greater than a surface area of the non-cleaning portion. The device can be capable of distributing a cleaning liquid directly to all faces of the cooking surface. Other embodiments related to cleaning devices that include rotary powered devices that has a cylindrical surface with grooves.

Other embodiments relate to cleaning devices. The devices can include a first face; a second face; and a plurality of edges, wherein the area of at least one face is greater than the area of any one of said edges, wherein at least one of said first face and said second face is adapted to conform to the surface of a surface that is to be cleaned.

The device can include the first and second faces and at least two, three, or four edges, for example. The first face can include at least one channel that extends the length of the first face. The second face can include at least one channel that extends the length of the second face. The first and second faces each can include at least one channel, wherein the channels meet at the junction of said first and second faces. It should be noted that the terms "channel" and "groove," can have the same meaning in embodiments described herein. In other aspects the device can include a third, a fourth, or more faces, for example. The area of the first and second faces can be, for example, greater than the area of any one of the edges.

Still further embodiments relate to cleaning devices that include grooves or notches that travel in parallel continuously across all sides or the entire circumference of the device. Other embodiments relate to cleaning devices that can include, for example, a cleaning element comprising a plurality of grooves or notches arranged in parallel continuously across the length at least one side of the cleaning element, wherein said length is greater than or equal to the length of at least on other side of the cleaning element. For example, in the case of square or rectangular device, the grooves and notches can run in parallel continuously across four of the faces. In other cases, grooves and notches can run perpendicular to the grooves and notches on the four faces, thereby creating a crossed or checkered design.

Other embodiments relate to devices that include more than one material on parts or faces of the device. For example, the different materials can have different cleaning, absorbing, and scouring characteristics. Multiple colors can be used, on the different materials, the different faces or sides, and/or on the same sides, materials and faces. The devices having more than one material can be used in methods of cleaning that include the use of such devices. The devices can provide flexibility in cleaning.

Embodiments relate to methods of making a cleaning device. The methods can include selecting a surface to be cleaned; choosing a material that is non abrasive to said surface; and configuring said material such that said material conforms to said surface.

Still further embodiments relate to cleaning devices that can include, for example, a first cleaning element including a first material; a second cleaning element including a second material; and a bonding layer, joining the first and second cleaning elements, wherein at least one of the first and second cleaning elements can include a cleaning surface including a plurality of channels.

The first cleaning element can include, for example, a first color, and the second cleaning element can include a second color. The first cleaning element can include a non-abrasive material, and wherein the second cleaning element can include an absorbent material. The first cleaning element can include a first non-abrasive material, and wherein the second cleaning element can include a second non-abrasive material. The first non-abrasive material is relatively less abrasive than the second non-abrasive material. Preferably, at least one cleaning element conforms to the surface of a cooking device that is to be cleaned.

Other embodiments relate to cleaning systems that can include for example a cooking device including a non-planar cooking surface; and a cleaning element including at least two cleaning surfaces corresponding to the non-planar cooking surface.

Some embodiments relate to cleaning systems including a cooking device including a non-planar cooking surface; and a cleaning element including one or more sides and at least two cleaning surfaces corresponding to the non-planar cooking surface, wherein said at least two cleaning surfaces comprise a length, wherein the length of said at least two surfaces is greater than or equal to the length of at least one of said one or more sides. Furthermore, in such systems, for example, an area of at least one of said at least two cleaning surfaces is greater than or equal to the area of one of said one or more sides.

Further embodiments relate to cleaning devices including, for example, a plurality of cleaning surfaces, wherein the cleaning surfaces are arranged to conform to a non-planar cooking surface. Also, some embodiments relate to cleaning systems including, for example, a cooking device including a contoured cooking surface; and a cleaning device including at least one cleaning surface that conforms to the contoured cooking surface.

Other embodiments relate to cleaning devices including, for example, a non-compressible cleaning element including at least one cleaning surface adapted to conform to at least a portion of a contoured cooking surface.

Also, some embodiments relate to cleaning devices including, for example, a spherical cleaning element including a plurality of grooves or notches arranged in parallel continuously across the entire circumference of the cleaning element.

Still further embodiments relate to cleaning devices including, for example, a rectangular cleaning element, which rectangular element can include, for example, at least a first cleaning face, wherein the first cleaning face can include a first plurality of parallel ridges that run the length of the first cleaning face; at least a second cleaning face, wherein the second cleaning face can include a second plurality of parallel ridges that run the length of the first cleaning face; at least a third cleaning face, wherein the third cleaning face can include a third plurality of parallel ridges that run the length of the third cleaning face; and at least a fourth cleaning face, wherein the fourth cleaning face can include a fourth plurality of parallel ridges that run the length of the fourth cleaning face, wherein the cleaning element can include at least two materials selected from the group consisting of foam, rubber, silicon, a synthetic material, polyester, cellulose, natural sponge, synthetic sponge, plastic, mesh, fiber, nylon, natural bristles, synthetic bristles, an organic polymer, an extrusion, and combinations thereof, and wherein the first, second, third and fourth pluralities of parallel ridges form a plurality of continuous ridges that transverse a perimeter of the cleaning element.

The ridges can be, for example, about ⅜ of an inch wide, and can be separated from one another by about ⅜ of an inch. The ridges can be, for example, 4 inches long. The first cleaning face further can include a fifth plurality of parallel ridges perpendicular to the first plurality of parallel ridges.

DETAILED DESCRIPTION OF THE PREFERRED EMBODIMENT

Figure 1A:
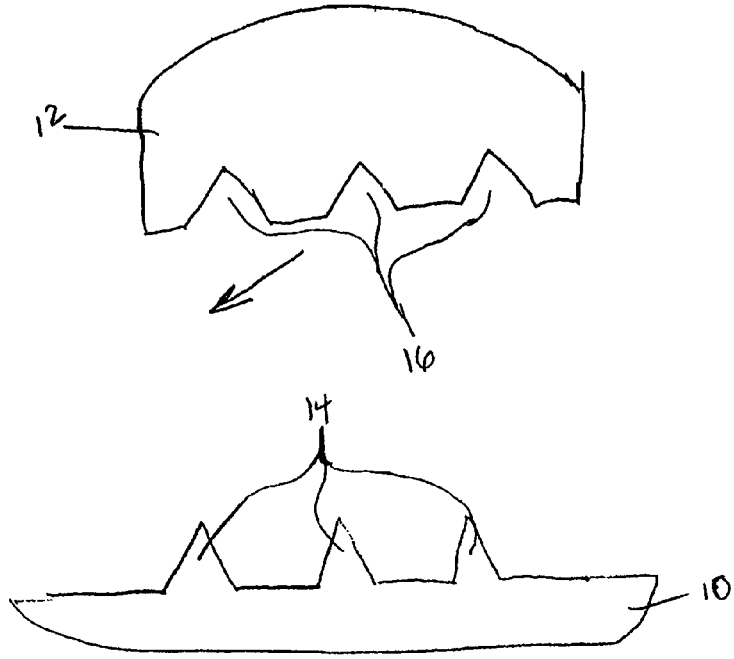
FIGS. 1A-B illustrate an exemplary surface that is to be cleaned and a conforming cleaning device.

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Many cooking devices, such as indoor and outdoor grills, sandwich makers, and waffle irons, include for example, non-planar or irregular parts and surfaces, including elevated ridges, ribs, grooves and/or channels. Indoor cooking grills, including indoor electric cooking machines, for example, may include ridges that sear the meat or other food while permitting the fat to drip and drain away. Unfortunately, the ridges can be difficult to clean because the high heat causes food to be "cooked" on to the cooking surface. Also difficulties can arise because the food sediments, including those from meats and sauces, can become trapped and cooked-on to the surface between the ridges. The cooking devices can also be difficult to clean due to the proximity of the ridges to each other, the depth of the ridges, and for some devices due to the delicate nature of their cooking surfaces.

Existing cleaning instruments clean these cooking devices poorly and inefficiently, and may damage the devices. One reason is because the cleaning instruments do not easily fit in between or into the ribs, ridges, channels and/or grooves so that it is very difficult to clean and maintain the cooking devices. For example, brushes and sponges may be too large or too thick. Furthermore, any cleaning instruments, such as towels, sponges or brushes for example, that are able to fit into the channels, ribs, ridges, and/or grooves, fail to adequately contact with all parts and sides of the surface that is being cleaned. This is due at least in part to the failure of such instruments to provide enough surface area that is in contact with the surface that is to be cleaned. Because of this, the user is unable to apply adequate cleaning force over enough area to efficiently clean the device. This can result in cooked-on residue being left in hard-to-reach parts of the grill. Towels may fit in or around the grooves, ridges, channels, and/or ribs, but it is still difficult to apply adequate pressure or force to clean all parts and sides of the cooking device surface. In the case of burned or cooked-on food, such as meat or fat, this can be especially detrimental to efficient and complete cleaning.

Many cooked or burnt-on foods are easier to clean if water and/or a cleaning liquid is applied to the foods. However, existing cleaning instruments fail to provide sufficient liquid to the area to be cleaned because the existing cleaning instruments either are not capable of conveying adequate liquid and or the instruments are not able to deliver the liquid to all parts and sides of the surface that is to be cleaned. The cleaning liquids can include water, soap solutions, detergent solutions, solvents, oils, and the like.

Additionally, existing cleaning devices provide improper protection for the user. In many cases it is most convenient to be able to clean cooked-on food while the food or cooking device remains relatively warm or before they are completely cool. Also, with many cooking devices the user's hand can be exposed to rough and/or hot parts because of the lack of protecting surface area. Many existing cleaning instruments are unable to withstand use against the warm surfaces and may fall apart, melt or lose their shape if they are used. Furthermore, such cleaning devices can be unsafe and inconvenient because they provide insufficient insulation against the warm food or device, and against any rough parts. Those existing cleaning devices that can protect against the heat and/or rough parts may be abrasive and damaging to the cooking surface.

In addition, as already mentioned existing cleaning instruments provide less total surface area in contact with the surface to be cleaned, and therefore cleaning force must be applied to a smaller area. This can result in a higher incidence of injury due to burns or contact with rough parts. It can also result in damage to the cooking surface because of the increased abrasive force that is exerted on less surface area in order to clean the hard to reach surfaces. It can also result in damage and increased wear and tear to the cleaning instrument.

Therefore, embodiments of the instant invention relate to cleaning devices that alleviate and overcome the above-mentioned concerns. Embodiments relate to cleaning devices that conform entirely, or in part, to the surface being cleaned. As such, the devices have more surface area in contact with more of the surface that is to be cleaned. This permits more efficient and safer cleaning for the user. In some cases, because more of the instrument is in contact with the surface to be cleaned, the user can exert force over more area on the cleaning device, and thus in a less abrasive manner. This can also result in less damage and wear and tear to the cooking device and encourage increased usage of the cooking device.

Embodiments also relate to cleaning devices that maintain their shape and integrity after a number of uses. They can also maintain their shape and integrity while used on rough parts, cold parts, warm parts, and even hot parts. The devices can maintain their shape and integrity after being cleaned and washed both by hand and by washing machines, including after being used in association with soap and common cleaning liquids and powders. Furthermore, embodiments also relate to devices that can carry and distribute a cleansing liquid to the area that is to be cleaned. For example, in some instances, the devices with a greater surface area in contact with the surface to be cleaned, also permits more cleaning liquid or solution to be carried and distributed to the cleaning surface. The device can be easily and frequently expunged of "dirty" liquid and re-supplied with fresh liquid for further cleaning, all while maintaining its integrity. The capacity to hold a cleansing liquid and put the liquid in maximal contact with the surface area of the surface to be cleaned can aid in cooling warm or hot devices, removing food and sediment, and in protecting the user. The cleaning devices can come with a cleaning liquid or cleaning agent embedded with the device or provided in a kit or separate package. Thus, the device can be ready to use. The cleaning agent can be a liquid, oil or dry agent, including those that are specially formulated for cleaning the delicate surfaces of particular types of grills.

As already mentioned, embodiments relate to devices that conform to the surface of the device that is being cleaned. "Conform" as used herein means that cleaning devices are configured to contact all or most of the surface that is being cleaned. Thus, in preferred embodiments, the cleaning device can be configured in the mirror image of the surface that is to be cleaned. Thus, in preferred embodiments, the cleaning device can have a surface that fits into or around the contours of the surface that is cleaned. For example, where the device that is to be cleaned has raised ridges or ribs, the cleaning device can be configured to have channels or grooves that fit around, over, and/or in between the ridges and ribs. The design of the cleaning devices, including the ridges, grooves and angles, permits the cooking devices to clean at many different angles, which can optimize the efficiency of cleaning and therefore shorten cleaning time, for example. Some cooking devices have ridges that have different heights at different parts of their length. For example, some may have ridges that individually vary in height. For example, one or more ridges may be taller near the front of the device, to prevent the food that is being cooked from sliding or rolling off of the cooking surface, while the same ridges are shorter at the opposite end. Accordingly, the instant cleaning devices can be configured to match the different heights of the ridges. However, "conform" does not mean that the instant devices have to be configured to exactly mirror the surface that is to be cleaned. Preferably, in some embodiments, the cleaning devices can be configured to match as closely as possible, while in other embodiments the devices are configured to generally follow the contours of the surface to be cleaned. Other embodiments include cleaning devices that can be used on many different cooking surfaces or cooking devices. In such embodiments, the cleaning devices may not be an exact mirror image of any of the devices, but they still provide contours that improve the ability of the user to safely and efficiently clean the device.

Figure 1B:
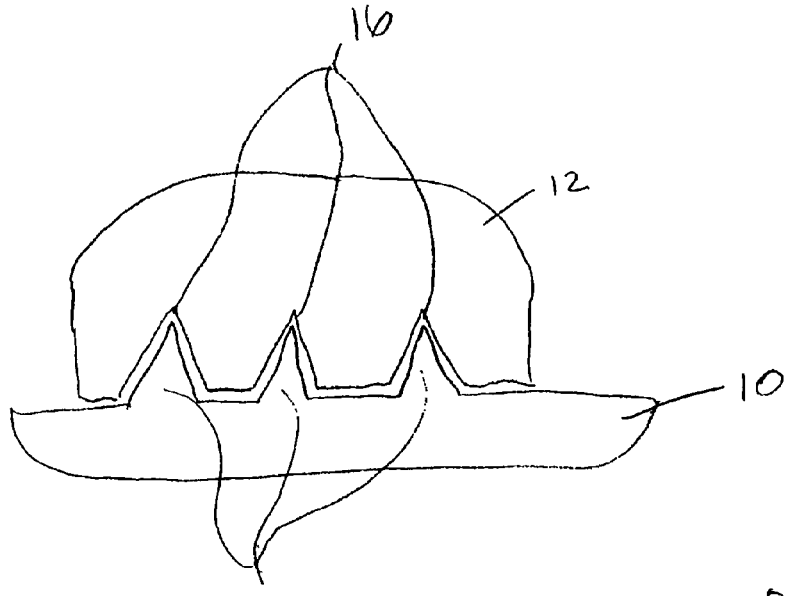
Figure 1C:
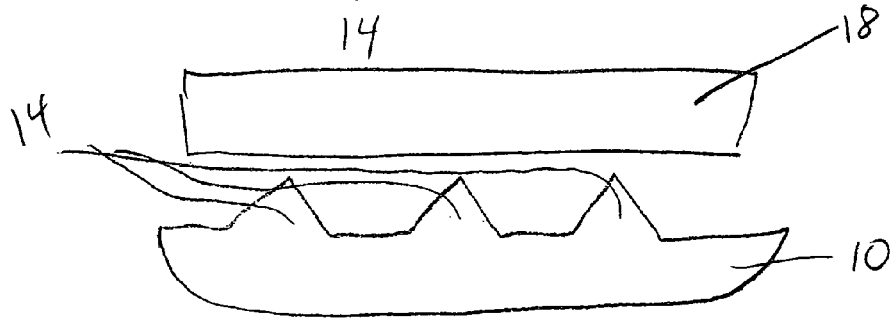
FIG. 1C illustrates an example of an existing cleaning instrument that is non-conforming.

FIGS. 1A-B and 2 illustrate two examples of a cooking device upon which the cleaning devices of the instant invention can be used. FIGS. 1A-B and 2A-D show non-limiting examples of how a cleaning device may "conform" to the surface that is to be cleaned. Referring to FIG. 1, it provides a front elevation view. FIGS. 1A and B include a cooking device 10 with ridges 14. The ridges 14 are shown as having a shape that ends in a point. The cleaning instrument 12 has channels or grooves 16 that conform in the mirror image to the ridges 14 on the cleaning device 10, such that the cleaning device 12 easily contacts with the surface that is to be cleaned. FIG. 1C illustrates an existing cleaning instrument 18. FIG. 1C illustrates the disadvantages of the existing cleaning instrument 18, which does not easily contact with cooking device 10 that has ridges 14, at least without force being exerted on the cleaning instrument 18.

Figure 2A:
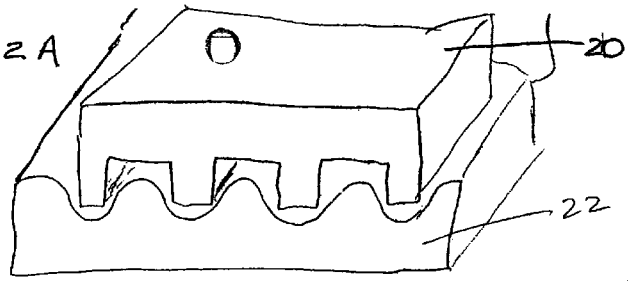
FIGS. 2A-D illustrate several non-limiting examples of conforming cleaning devices and surfaces to be cleaned.
Figure 2B:
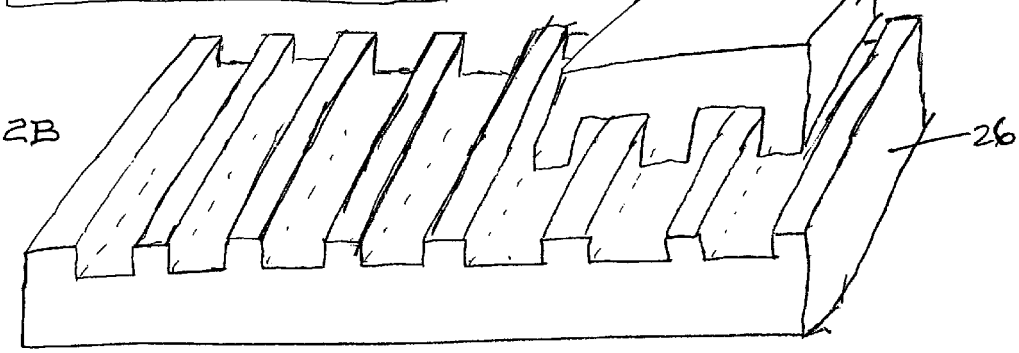
Figure 2C:
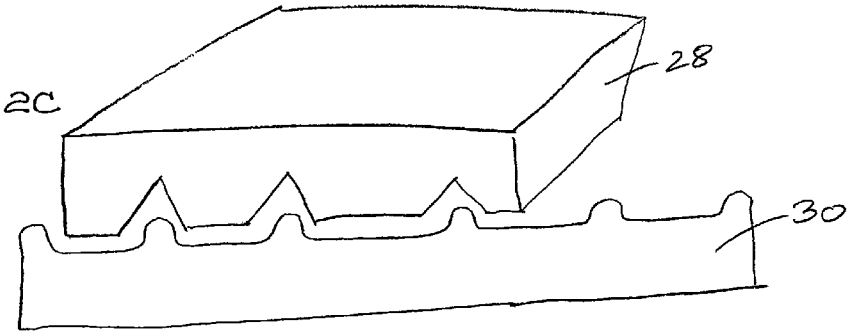
Figure 2D:
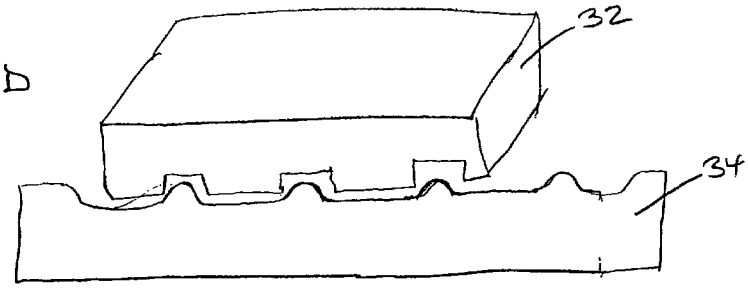

FIGS. 2A-D illustrate a number of exemplary cleaning device conformations in front elevation views. These show that, in some embodiments, "conform" can be construed broadly. In other embodiments, "conform" can be construed mean conform closely to the surface that is being cleaned. The cleaning devices 20, 24, 28, and 32 all "conform" in some degree to the surfaces of the cooking devices 22, 26, 30, and 34. FIG. 2B with a front elevation and top view, illustrates the situation where the cleaning device 24 is smaller than the total surface that is to be cleaned, yet still conforms to part of the surface, and can be moved to clean the remaining parts of the surface that is to be cleaned on cooking device 26. Each of FIGS. 2A-D illustrates a situation where the cleaning instrument 20, 24, 28, 32 has a geometry that is not an exact mirror image of the surface that is being cleaned, yet each is considered to conform to the surface, especially when considered in relation to existing planar cleaning instruments, including that illustrated in FIG. 1C, for example. Again FIGS. 2A-D provide several examples of cooking surfaces and cleaning devices. The skilled artisan can easily recognize the many other variations contemplated herein, especially in view of the list of cooking device manufacturers that is provided below. Again embodiments include cleaning devices that are "generic" and still "conform," and that can efficiently and safely clean many different cooking surfaces, each with a different geometry, even though the cleaning devices may not be configured in the exact mirror image of the devices that are being cleaned.

The cleaning devices can be designed to fit or conform to any cooking surface. Preferred cooking surfaces include indoor cooking grills, such as those listed below, and more preferably those with non-stick surfaces. Additional preferred cooking surfaces include waffle machines. For example, the devices can conform to differently shaped ridges, ribs, channels or grooves, including those that are rounded, square, triangular, pyramid shaped, etc. In preferred embodiments the cleaning devices match or conform exactly to the surface that is being cleaned. However, in other embodiments the devices generally track the contours of the surface that is being cleaned. Some indoor cooking machines or grills have lids that close to contact or press both sides of the item that is being cooked. In some cases, the cooking surface of the lid will have a different surface contour than the base cooking surface. Thus, in some embodiments, the devices can have one face that conforms to the cooking surface of the base, and another face that conforms to the cooking surface of the lid. Additionally, the cleaning devices can be made from materials that are flexible or that can be com-pressed. Materials are discussed in more detail below. The devices can also be designed to comfortably fit in the user's hand or to permit easy use by the user by fitting the contours of the hand of the user.

The devices that conform to the surface that is to be cleaned provide numerous advantages. The devices are able to clean more surface area because they have a greater surface area that can contact more surface area of the device that is being cleaned. Also, less user effort or "elbow grease" is required because the cleaning device already conforms to or matches with the contours of the surface. The user does not have to force or "stuff" a cleaning instrument into a channel or groove, as it fits or conforms by design. In most cases, the user only has to move the cleaning devices in a lateral or horizontal motion so as to move the device along the length of the surface that is to be cleaned. In some cases the user applies little or no vertical force or pressure. By not having to apply much or any vertical force, the devices can be safer for the user because it is less likely that the user's hand will contact rough parts or hot parts on the device. Also, less vertical force results in less wear on the cooking device, especially those devices with delicate surfaces such as Teflon®. The user can, however, use more vertical force or leverage if desired or necessary, and the instant devices still permit an efficient safe cleaning of the cooking devices, because the designs of the instant cleaning devices better conform to the surface, permit greater cleaning liquid to be conveyed, and provide greater protective density. This allows cleaning while the apparatus is warm, thereby optimizing the user experience of the cleaning device.

Embodiments also relate to devices that can carry and distribute a cleansing composition, such as a cleansing liquid, to the area that is to be cleaned. In some situations it is advantageous to carry and distribute to or flush the surface that is to be cleaned with a cleansing liquid such as water for example. The instant devices fit the contours of the surface that is being cleaned without as much, if any, compressing or deforming of the cleaning device. The cleaning device can therefore carry the cleansing liquid to the surface that is being cleaned. For example, in some instances, the devices with a greater surface area in contact with the surface to be cleaned, also permits more cleaning liquid or solution to be carried and distributed to more of the surface that is being cleaned. Existing towels and sponges must be manually deformed or pressed into the channels and grooves of the cooking devices. Thus, any liquid carried by the towels or sponges is forced out so that it does not efficiently reach all areas of the surface that is being cleaned.

Other embodiments relate to cleaning devices that last and maintain shape, integrity and functionality, even at high temperatures, after 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, and the like number of uses. More preferably, about 35, 40, 45, 50, 55, 60, 65, 70, and the like number of uses. Even more preferably, about 75, 100, 125, 150, and the like number of uses. The devices can be washed by hand, in a dishwasher, or in a clothes washer and continue to maintain shape, integrity, and functionality after 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, and the like number of uses. More preferably, about 35, 40, 45, 50, 55, 60, 65, 70, and the like number of uses. Even more preferably, about 75, 100, 125, 150, and the like number of uses.

The devices can be of any color and of various shapes and sizes. For example, the devices can be square, rectangular, circular, triangular, spherical, cubic, pyramid-shaped, diamond shaped, star shaped, mounded, tetrahedral, oval, elliptical, cylindrical, with a handle, hand contoured, and the like. The devices can be shaped to look like any object, including novelty objects, such as for example, a football or a boxing glove. The devices can also be adapted for promotional purposes where the channeled groove and corresponding notch design can be integrated into devices shaped like footballs, racecars, appliances, such as indoor grills, licensed characters and images. Although such promotional devices can. The devices can be shaped to fit the contours of the user's hand or fingers, or include an aperture or holes in which the hand or fingers can be inserted. The sizes can vary as well. In some embodiments the device is of a size that conforms to at least one rib, groove, ridge or channel. In preferred embodiments the device conforms to more than one rib, groove, ridge or channel. Preferably, in some embodiments the cleaning device can have at least one type of material on one face and at least a second type of material on a face, or simply more than one type of material on any part of the device including the same face. Preferably the device can be of a size that permits the user to move the device laterally, horizontally or so as to provide "scrubbing" movement. However, in other embodiments the device may cover all or nearly all of the surface area of the cooking device. For example such a device can be used to soak the cooking device. Such cleaning devices can be used to store the cooking device, thereby providing a padded surface, which can protect the cooking device during non use. Some non-limiting exemplary dimensions are provided below in the Examples.

The cleaning devices can conform to the surface that is to be cleaned on one face, more than one face, or on all faces. FIGS. 1A-B and 2A-D, discussed above, provide examples of cleaning devices that conform on one face. Each of those cleaning devices can be configured to conform on more than one face. For example, in the case of a device that is shaped as a rectangular block or a cube, one face can be configured to conform to the cooking surface, or more than one surface can be configured to conform. As another example, the device can be shaped as a sphere and be configured to conform to the ridges of the cooking device by including one or more grooves and/or ridges that completely traverse the circumference of the sphere. Another example includes a block device featuring a scouring pad surface in all of the grooved channels and perpendicular notches. Other embodiments can conform in more than one direction on the cleaning device. For example, a block or cube may have channels that cross each other at a 90-degree angle on one or more faces. Again, the ridges, ribs, channels, grooves, and the like of the cleaning devices can be configured in any suitable orientation.

The cleaning devices can be configured to conform to any cooking device, including indoor cooking grills. Some exemplary manufacturers that make such devices that can be cleaned using the instant cleaning devices include Aroma, Betty Crocker, Black & Decker, Cooking.com, DeLonghi, Deni, Dualit, Equipex, Farberware, GE, Hamilton Beach, Kuhn Rikon, Maxim, Nesco, Oster, Philips, Presto, Proctor Silex, Rival, Salton (e.g., George Foreman Grill®), Santa Fe, Sanyo, Star, Swiss Specialty, Swissmar Imports, T-FAL, Thermos (Grill-2-Go brand), Toastmaster, Villaware, Welbilt, West Bend, Zojirushi, and the like.

In other embodiments, the cleaning devices can be configured to conform to other appliances, such as, for example, waffle irons, sandwich makers, pizza ovens, juicers, crepemaker, bread ovens, choppers and other similar cookware. Preferably, in some embodiments, the devices can be configured to conform to cooking devices such as the category of electric, two sided waffle irons. Manufacturers of such devices include Krups, Toastmaster, Hamilton Beach, Cuisinart, Kenmore, VillaWare, Oster, Black and Decker and the like with unique ridged patterns. The cleaning devices can simply mirror (at least in part) the surfaces that are to be cleaned, for example, thereby conforming to the surface to be cleaned. Example, 5 below illustrates one exemplary embodiment suitable for such cooking devices. In other embodiments, devices with parallel channels or ribs can be used to clean such cooking devices. The cleaning devices for use with these appliances can also deliver a cleaning composition, including, for example, soap, water and other cleaning substances as set forth herein.

In other preferred embodiments, the cleaning devices as described herein can be used to clean automotive parts, tools and general use equipment categories. For example, the cleaning devices with grooves and or channels can transfer wax and polymer cleaners to car rims, special tools, vinyl, leather, plastic, rubber and all other surfaces, particularly surfaces that are not planar. Cleaning devices can be made with dimensions that contour to such articles that are to be cleaned. Furthermore, the cleaning devices can be used to apply wax to skis, to clean golf clubs, fishing rods and tackle and camping equipment. In short, the cleaning devices can apply solvent, cleaner and protectants to multiple surfaces, products and places. The cleaning devices can also be brought into common use areas such as bathrooms, garages and all living spaces where items such as lamps, desks, dressers, night-stands, or anything with a cornered edge, or conical shape such as a spigot, faucet or handle need the application of cleaner, or removal of dirt, sediment, grease and other substances.

Figure 13:
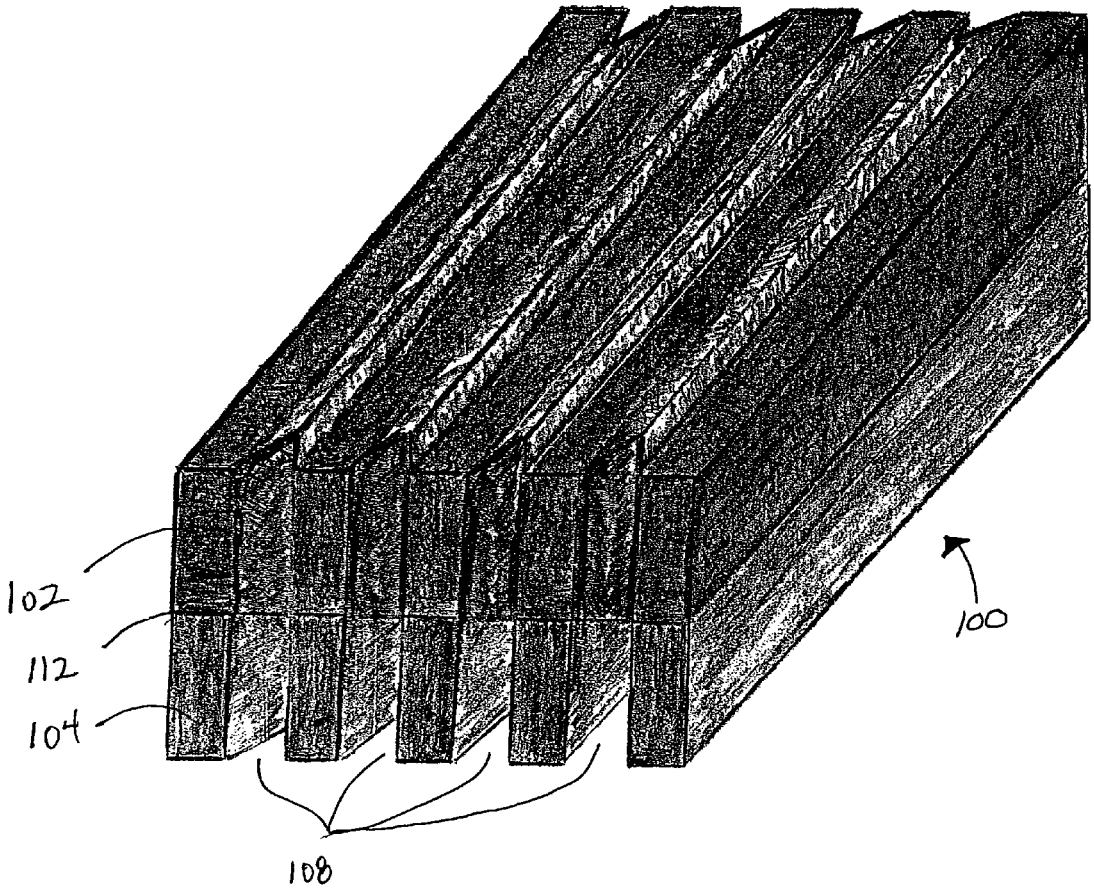
FIG. 13 illustrates a perspective view of an exemplary cleaning device.

The cleaning devices can be made of any suitable material, and in various combinations. Preferably, in some embodiments the material is one that can be used without harming or damaging the surface of the cooking device. For a less delicate cooking device, such as many outdoor cooking devices, for example, the material may be more abrasive and sturdier. For cooking devices that include more delicate surfaces, a less abrasive material can be used. In other embodiments the devices can be made of a material that is capable of carrying and delivering a liquid to the surface that is to be cleaned. In some embodiments, the cleaning device can include one material on one or more faces and another material on one or more other faces. One example of such a cleaning device is illustrated in FIG. 13. For example, a porous cellulose or foam sponge material can be used on one face, while another face can include a more abrasive plastic or polymer. Having a different material on one or more of the cleaning faces can allow the user to apply differing amounts of cleaning force and vary the type of cleaning liquid, if any, that is used. The use of a different material on a different face provides added flexibility for the user to select the optimal cleaning conditions for the particular circumstances. As one example, one face may provide excellent absorbency to convey a cleansing liquid, for example, while another face can provide enhanced scrubbing, for example. The device can include a handle or a hook on one face, or any other like component. In embodiments the cleaning devices can be made of materials that are durable and maintain integrity after one or more uses, under various conditions including elevated temperatures, and after one or more washings. The size can be varied for both large and small cleaning devices, included "super" size cleaning devices, which can be used, for example, to clean larger cooking devices.

Exemplary materials for the cleaning devices include all types of foam, porous rubber, silicon, synthetics, synthetic foams, formed polyester, cellulose materials, sponge materials, plastic meshes, wound plastic fibers, nylons, organic polymers and related extrusions. Specific exemplary materials or material substrates include polyether or polyester, low or high density, small, large or twin pore sizes, closed or open cell, non or flame retardant, flexible or semi rigid, plain, melamine or post treated impregnated foams, and the like. Also, neoprene, natural rubber, SBR, butyl, butadiene, nitrile, EPDM, ECH, polystyrene, polyethylene, polypropylene, EVA, EMA, metallocene resin, polyurethane, PVC, blends of any of the above, and the like. Natural sponges can be used and include those from the aquatic animal phylum Porifera, and from the dried, processed skeletons of certain species used to hold water, for example. Preferably, cellulose-based sponges can be used. Cellulose-based sponges can include those which are derived from plant products for example. More preferably, synthetic foam can be used, and even more preferably synthetic foam can be used on at least one face and polyester on at least one face. Synthetic sponges can be constructed of porous rubber, synthetic foam, other plastic and rubber derivatives, and the like, for example. In other embodiments the cleaning devices can be made or include abrasives on one or more sides/faces. For example, the abrasive can be steel wool, plastic wool, ceramics, sand or stone composites, plastics, wires, metals, and the like. The skilled artisan can easily configure devices from many other materials consistent with the discussion provided herein.

Embodiments of the invention relate to methods of designing and/or making the cleaning devices described herein. The methods can include selecting an appropriate material based upon the surface that is to be cleaned or surfaces that are to be cleaned, including the uses of the cleaning surface, the construction of the surface, and the materials of the surface. Selection of materials can include selection based upon the need or lack of need to apply liquid to aid in cleaning, or the need to clean while the surface is warm or hot. The methods of making the cleaning devices can include shaping a material to conform to the surface of the cooking device that is to be cleaned. The shaping can include consideration of the size of the cooking device, for example. The cleaning devices can be shaped using all forms of manufacturing methods. This can include, for example, extrusions, hand cutting or shaping, die-cutting, precision lasering, sawing, design-specific molds, and any other like method, for example. Also, special tooling and/or molds can be designed and manufactured. The methods can include, for example, gluing or otherwise bonding different materials, using specific tooling, and the like to produce the cleaning device. The methods can include a multi-step tooling, assembling process.

Normal manufacturing methods can include all of the above, but the devices can also be manufactured through a combination of the above processes, or any as a stand-alone method. That is, a prefabricated mold can be used to make the entire cleaning devices, or a prefabricated mold can be used for one step in the process. For example the devices can be made by a prefabricated process, and then by a die-cut press for a subsequent step before being packaged as a finished product.

Embodiments also relate to methods of cleaning cooking devices using a cleaning device that conforms to at least a part of the cooking surface(s). The methods can include a cleaning device that provide greater surface area and coverage of the surface(s) that is to be cleaned. Again this permits as desired increased liquid distribution, greater surface coverage, increased user protection, and the use of less user force. Thus, the methods include the use of a device that can distribute liquid over a larger surface area, that protect the user, and that require less user force or "elbow grease" to adequately clean.

Other embodiments include methods of cleaning where at least one face of the cleaning device contacts with about 1, 3, 5, 10, 15, 20, 25, 33, 40, 50, 60, 66, 70, 74, 80, 85, 90, 95, 98, 99, and 100 percent of the surface of the cleaning device.

EXAMPLE 1

Figure 3:
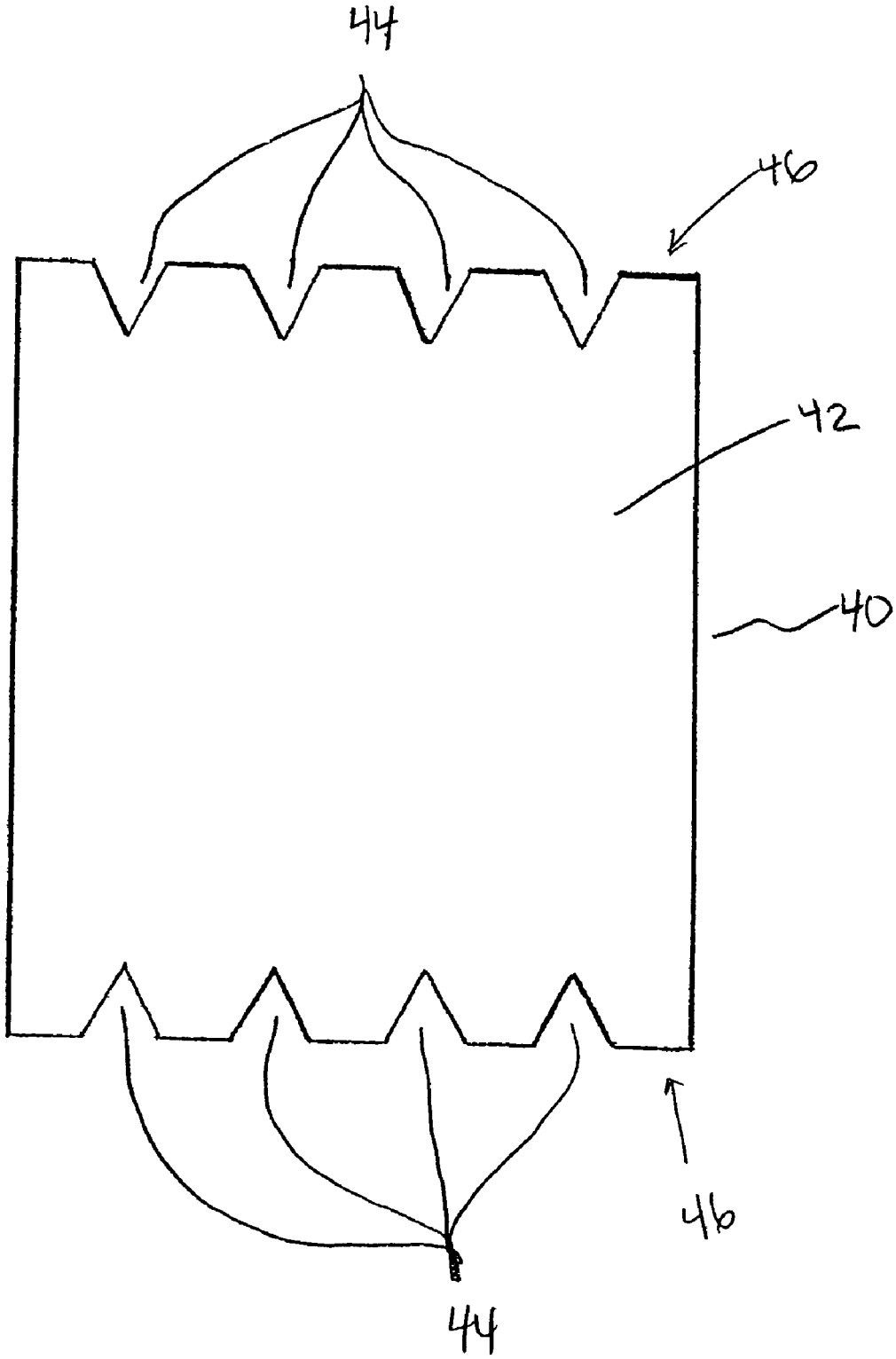
FIG. 3 illustrates a top view of an exemplary cleaning device.
Figure 4:
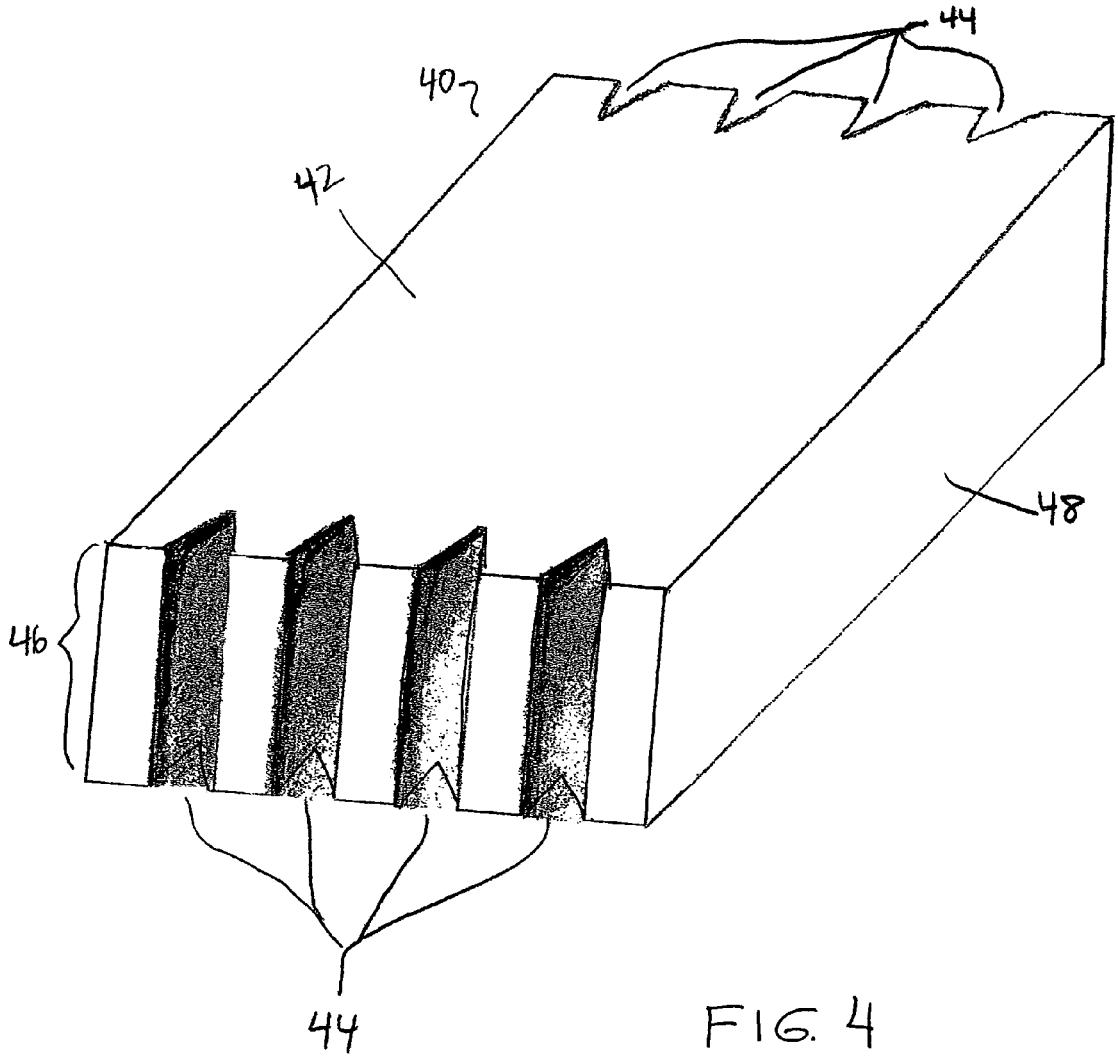
FIG. 4 illustrates a perspective view of an exemplary cleaning device.
Figure 5:
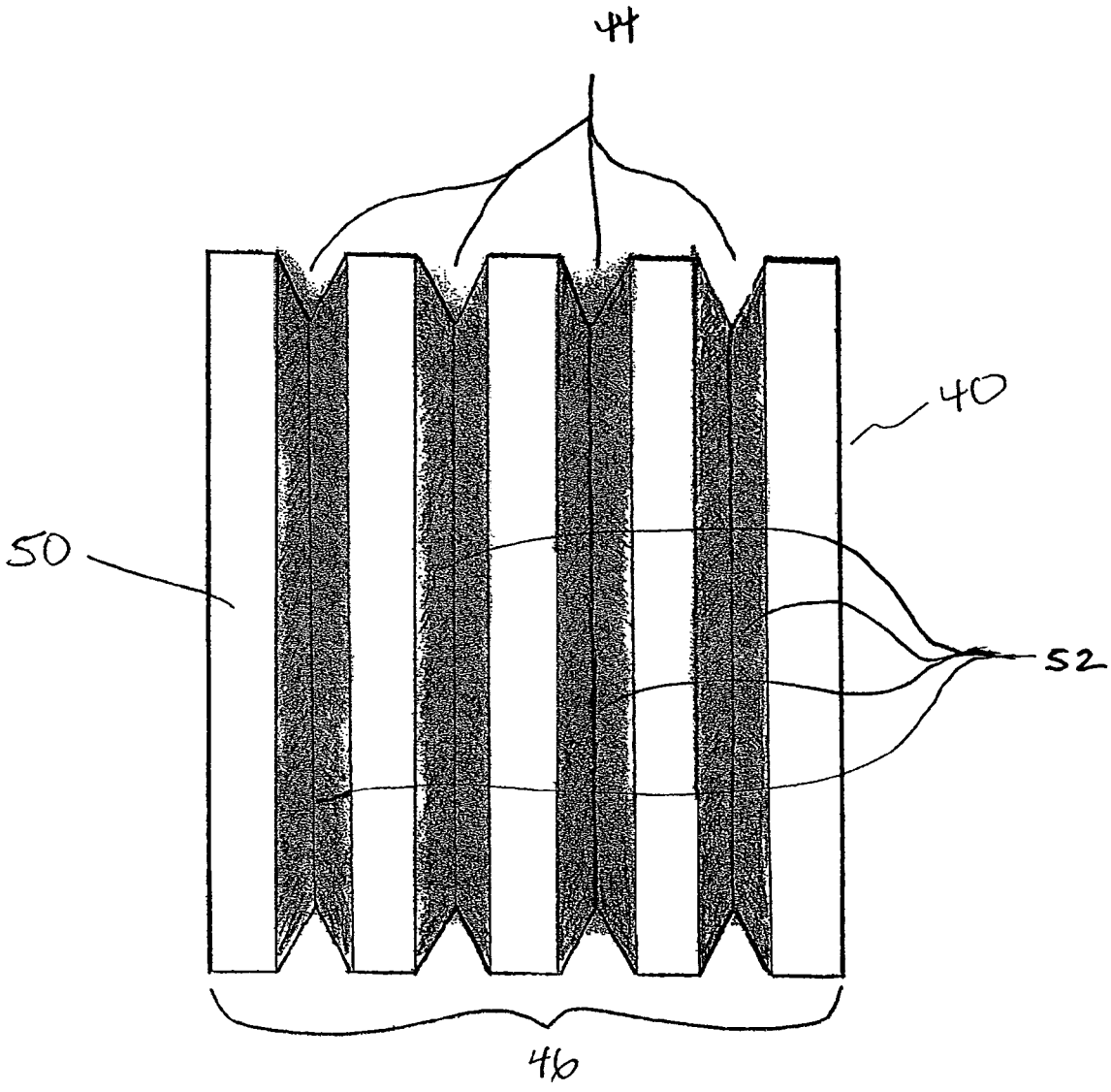
FIG. 5 illustrates a bottom view of an exemplary cleaning device.

FIGS. 3-7 show various views of an exemplary cleaning device. This device exemplifies a device that conforms on more than one face or side. In the illustrated embodiment, the cleaning device was cut by hand. FIG. 3 is a top view of a cleaning device 40 showing the top 42 of the cleaning device 40. The device 40 was made from a suitable material. The material was natural cellulose sponge. The device in FIG. 3 included notches/grooves 44 on each end 46. The notches/grooves 44 run the length of ends 46 as shown in FIG. 4 shows the top 42, the side 48, and one of the ends 46. FIG. 4 shows the grooves 44 that run the length of one face, which is the end 46. FIG. 5 shows the bottom view with the bottom 50 of the device 40. FIG. 5 also shows the channels 52 that run the length of the bottom face 50 and which conform the surface of the cooking device.

Figure 6:
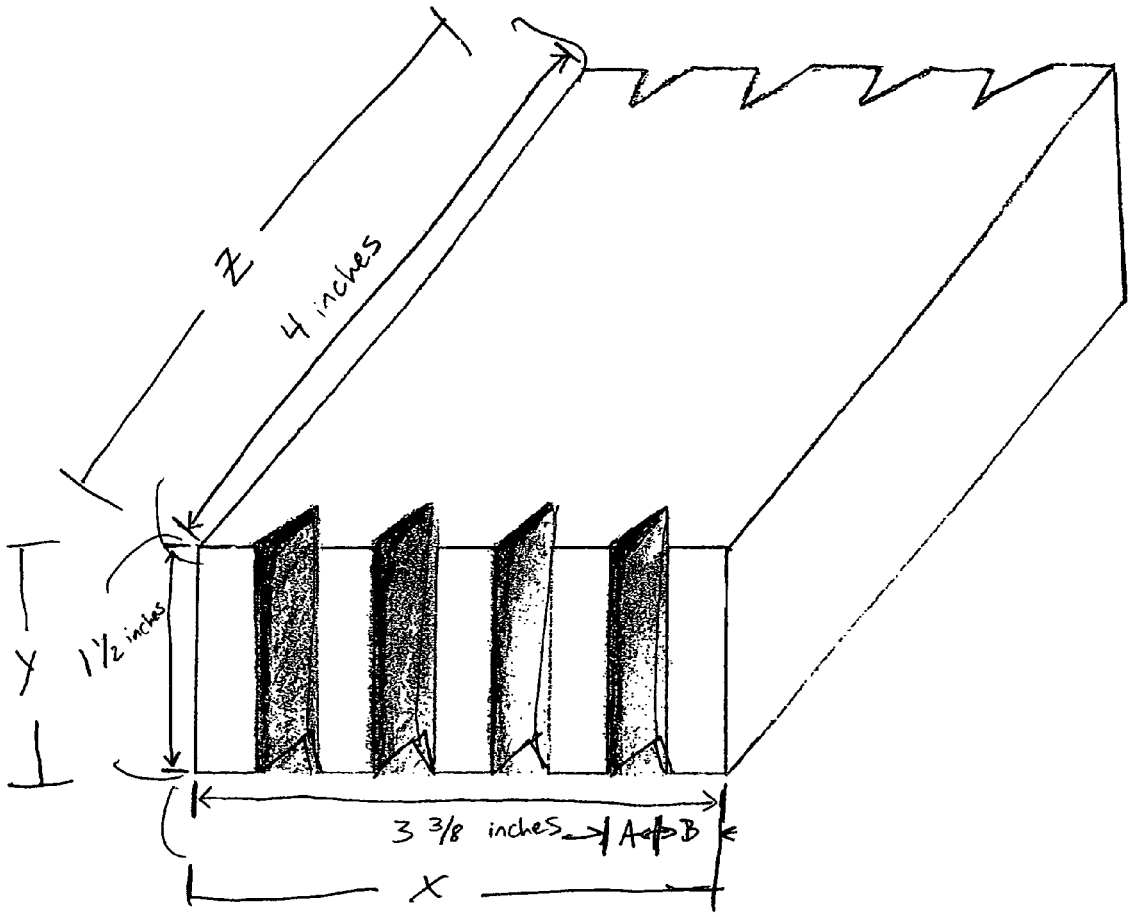
FIG. 6 illustrates a perspective view of an exemplary cleaning device.

As shown in FIG. 6, the device had a height "Y" of 1½ inches, a length "Z" of 4 inches, and a width "X" of 3⅜ inches. FIG. 6 shows that the device notches/grooves were ⅜ of an inch at the widest part "A" with ⅜ of an inch gaps in between "B", and extend along the entire length Z of the device 40.

Figure 7:
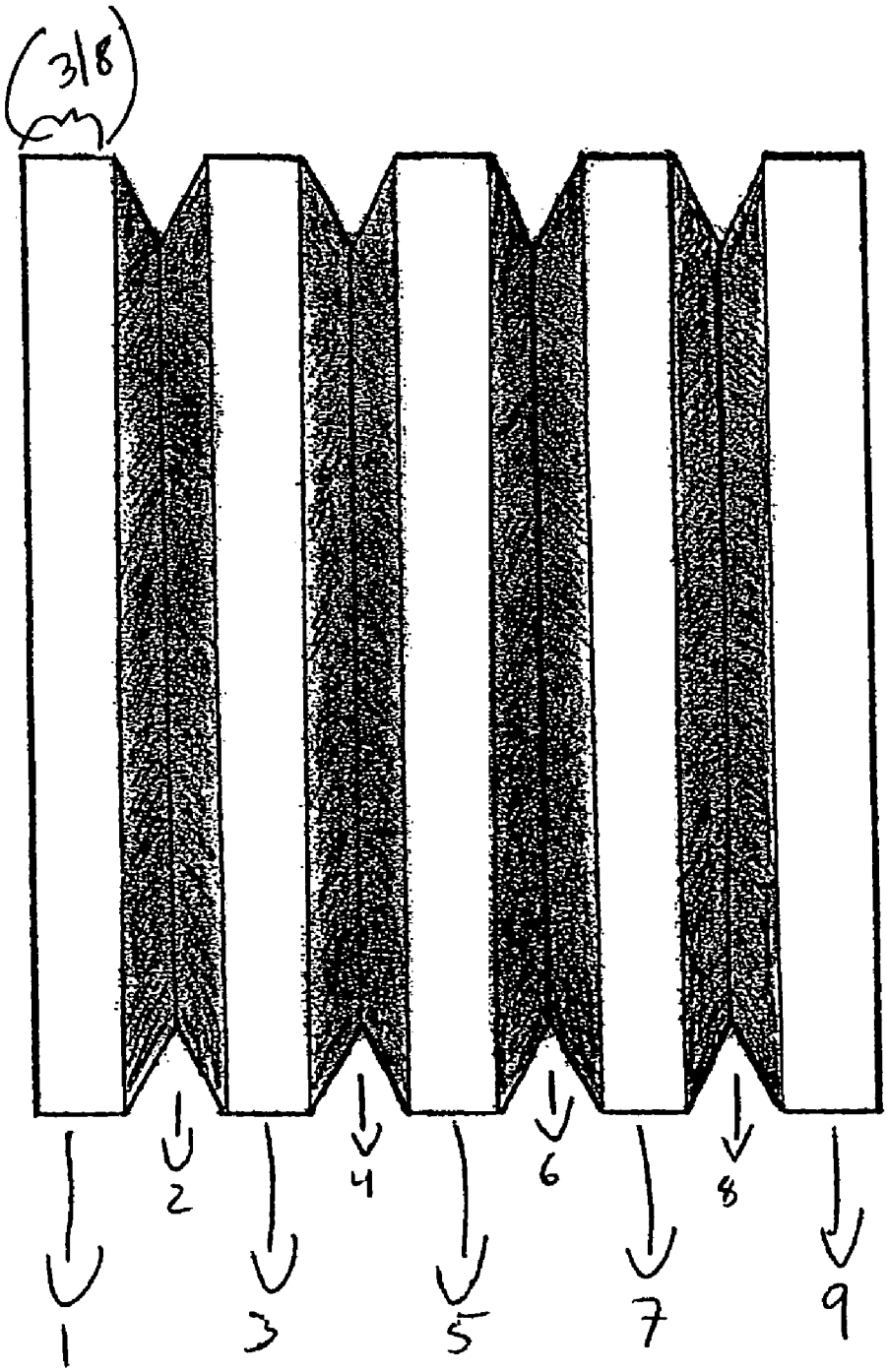
FIG. 7 illustrates a bottom view of an exemplary cleaning device.

FIG. 7 shows an embodiment wherein each of the notches/grooves 2, 4, 6, 8 and each of the spaces between the notches/grooves 1, 3, 5, 7, and 9 are uniformly ⅜ of an inch wide. It should be noted that the measurements can be altered. Preferably the lengths and measurements conform the particular surface that is to be cleaned. Although the notches/grooves come to a point in a triangular fashion, they can also be configured to be rounded or squared, as necessary to conform to the surface that is to be cleaned.

EXAMPLE 2

Figure 8:
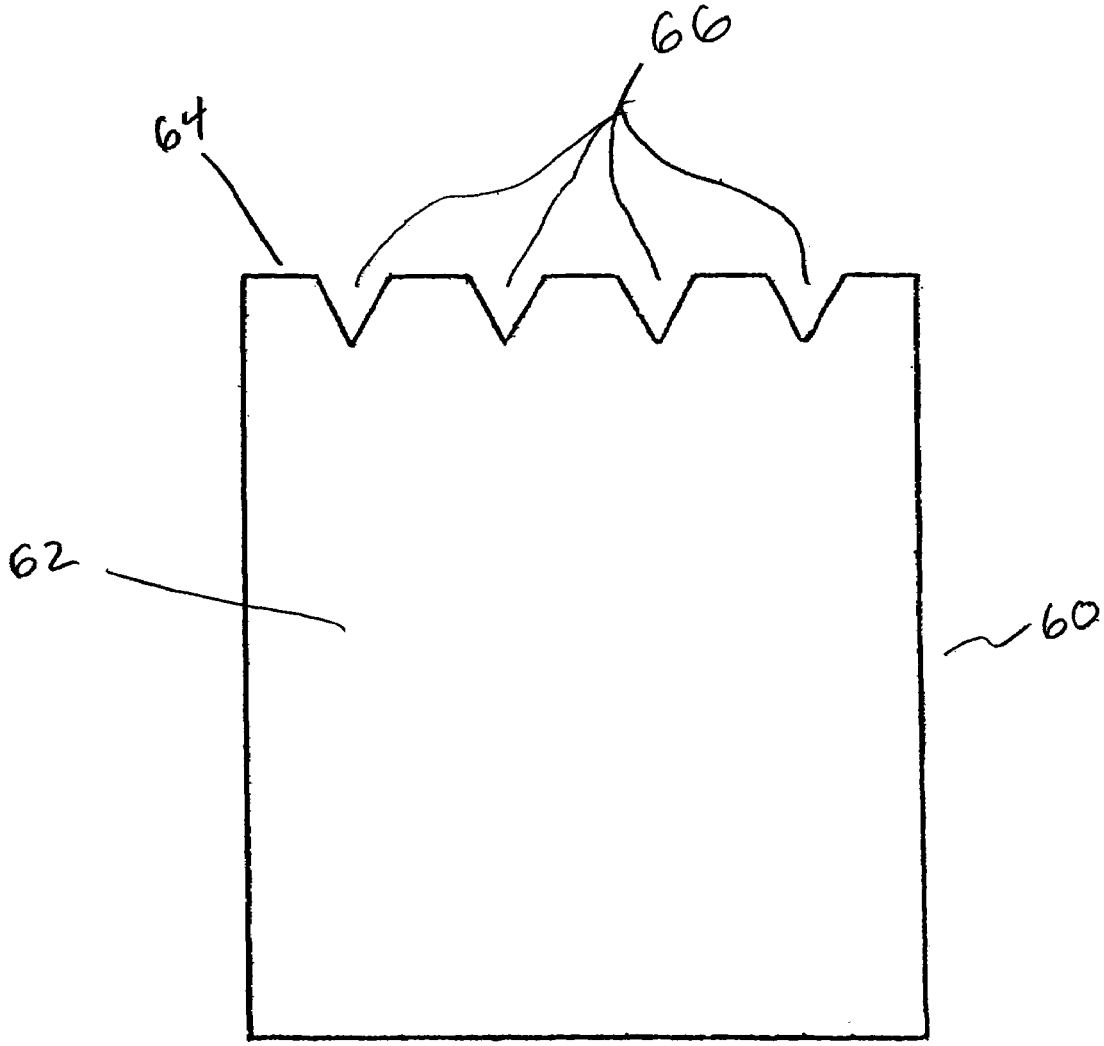
FIG. 8 illustrates a top view of an exemplary cleaning device.
Figure 9:
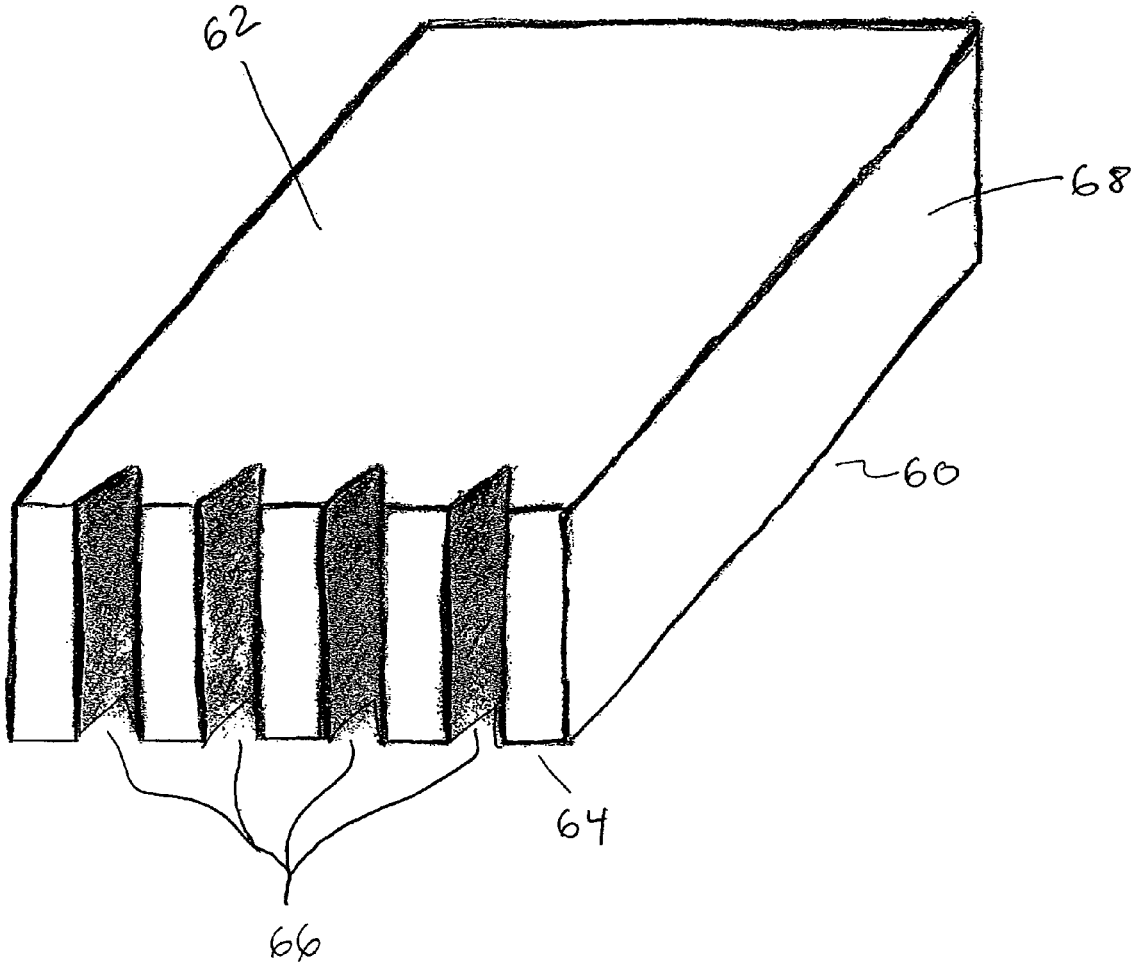
FIG. 9 illustrates a perspective view of an exemplary cleaning device.
Figure 10:
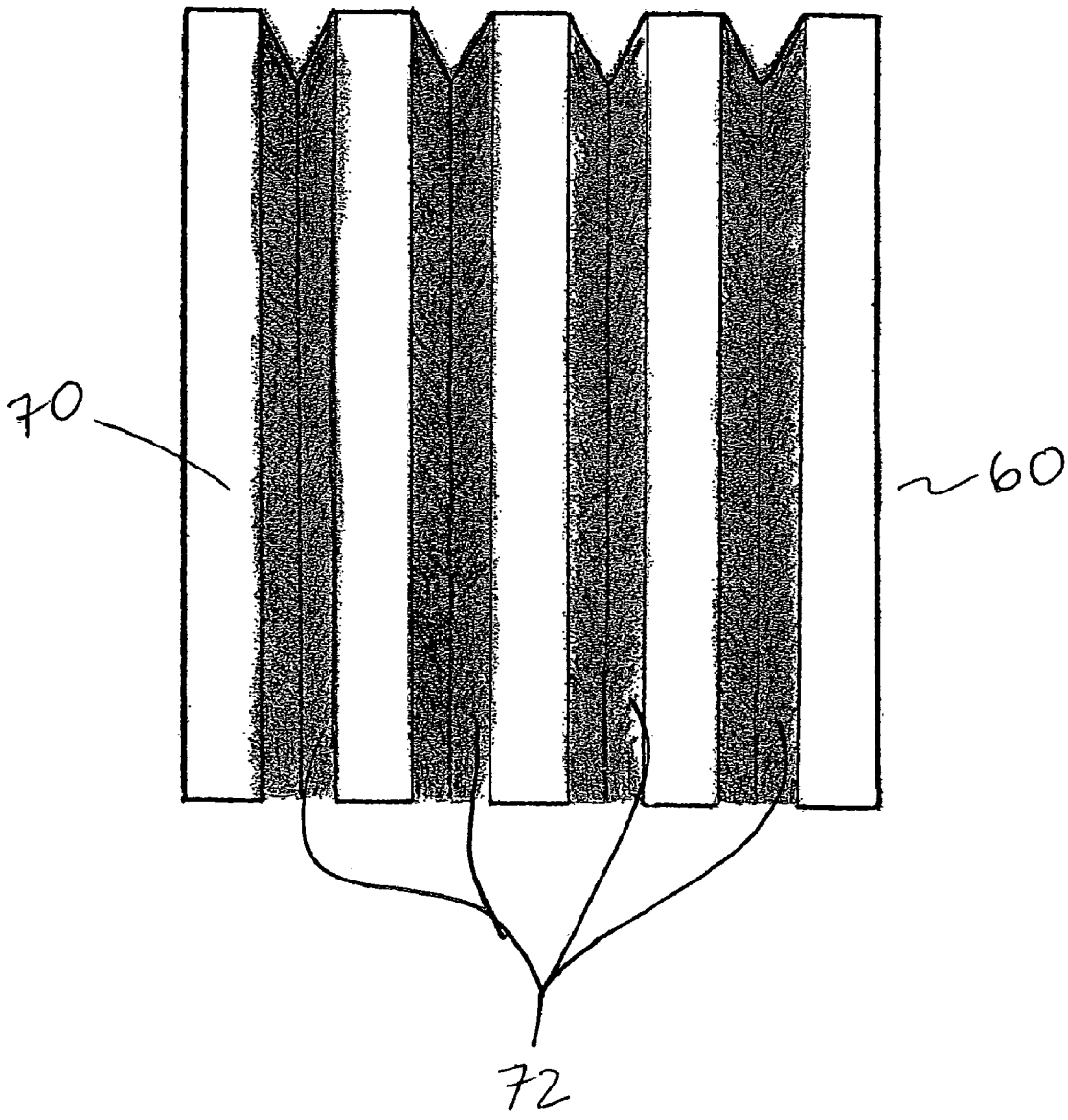
FIG. 10 illustrates a bottom view of an exemplary cleaning device.
Figure 11:
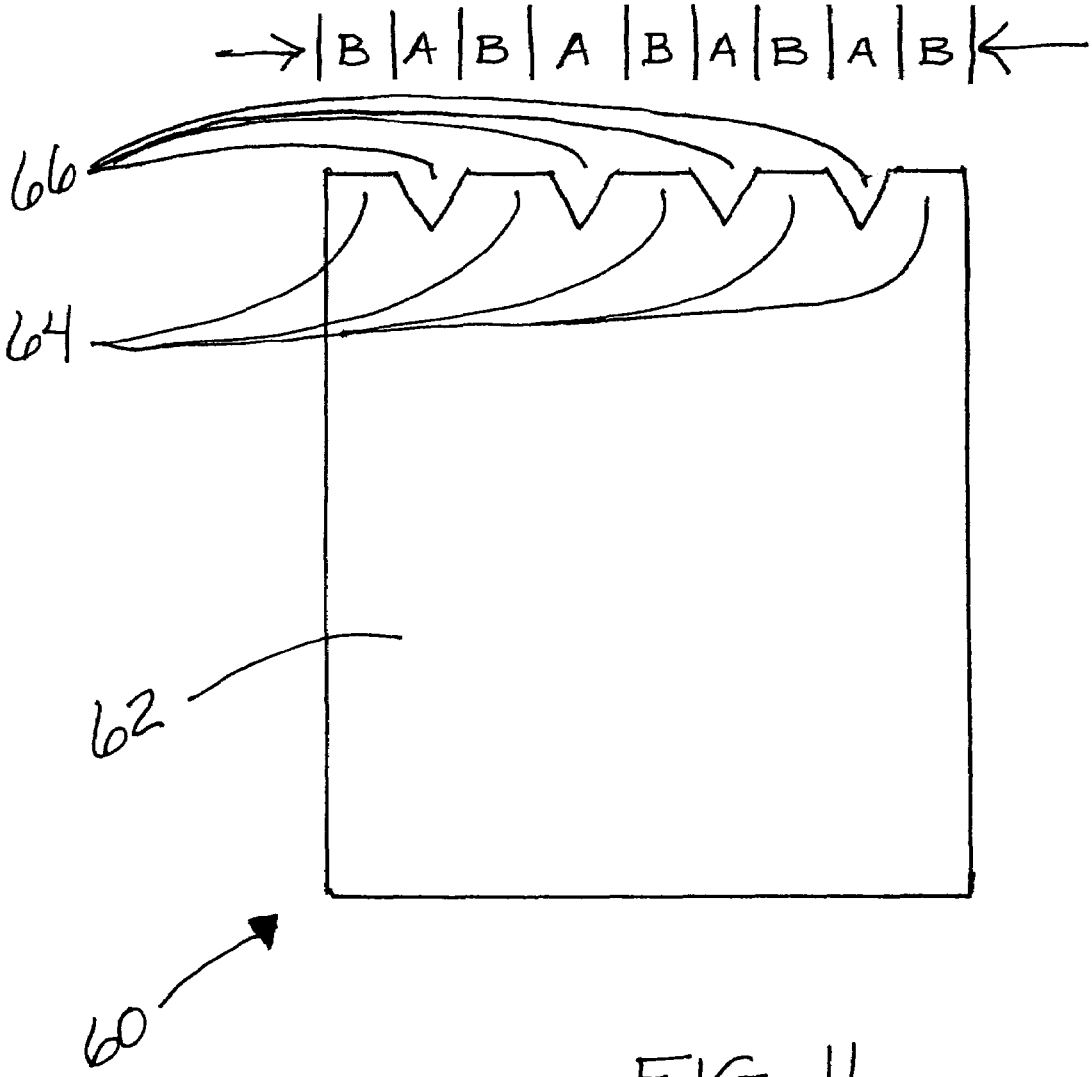
FIG. 11 illustrates a top view of an exemplary cleaning device.

FIGS. 8-11 show a cleaning device that conforms on two faces to the surface that is to be cleaned. FIG. 8 shows the top view of device 60 with a top 62 and one end 64 with notches/grooves 66. FIG. 9 provides an additional view of the device 60 showing the top 66, end 64, side 68, and that further illustrates the end 66 with notches/grooves that run the vertical length of end 64. FIG. 9 also includes a view of one side/face 68. FIG. 10 shows the bottom view that includes the bottom 70 of device 60. The bottom 70 also includes channels 72 that run the length of the device 60 and which conformed to the device that is to be cleaned. FIG. 11 shows the top view, which includes the top 62 of device 60.

FIG. 11 shows that the width of the notches 66, "A", and the distances between notches 64, "B", for this particular device are ⅜ of inch. This device conforms to the cooking device that was cleaned by the cleaning device.

EXAMPLE 3

Figure 12A:
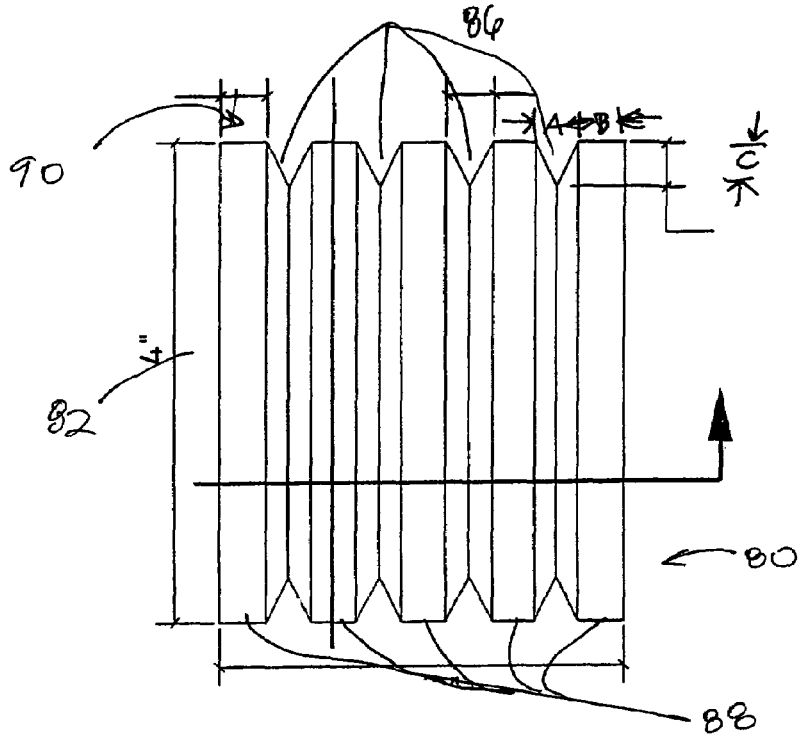
FIGS. 12A-C illustrate a top, end and side view of an exemplary cleaning device.
Figure 12B:
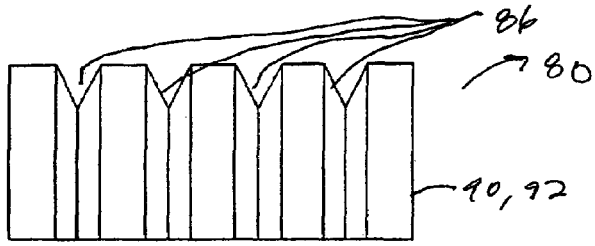
Figure 12C:
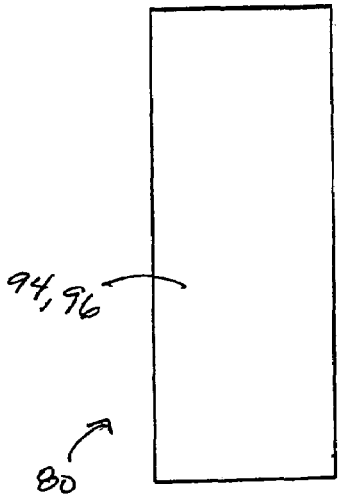

FIG. 12A-C show another exemplary cleaning device in several different views. FIG. 12A shows the top view of device 80 with a top cleaning face 82 with a plurality of notches/grooves 86 arranged in parallel along the length of the top cleaning face 82. The notches/grooves 86 are separated by a plurality of ridges 88 that form end cleaning faces 90, 92. FIG. 12B shows an end view of the device 80. As illustrated, the plurality of notches/grooves 86 extend on to the end faces 90, 92. FIG. 12C is a side view showing an embodiment where the notches/grooves 86 are not provided on the side faces 94, 96.

FIGS. 12A-C show a device wherein the notches/grooves have a width "A" of ⅜ of an inch, which are separated from one another by a distance "B" of ⅜ of an inch and have a depth "C" of ⅜ of an inch. In one alternative embodiment, the notches/grooves have a depth "C" of ½ of an inch. The dimensions are provided for exemplary purposes.

EXAMPLE 4

FIGS. 13-16 illustrate another exemplary cleaning device in several different views. FIG. 13 is a perspective view of a cleaning device 100. The device 100 includes a lower side 102 and an upper side 104 joined by an adhesive 112. The device 100 also comprises a plurality of grooves and notches 108.

The cleaning device was made of two different materials. The lower side 102 was made of polyester and the upper side 104 was made of synthetic foam. The polyester provided a different texture for cleaning and a different absorbency, for example, and visa versa. The polyester can be more abrasive when used on some cooking devices. The synthetic foam is generally more absorbent.

Although the dimensions can be altered and varied, the particular device was 4 inches long, 2 inches high and 3⅜ inches wide. In the particular figures, the two sides have the same size and dimensions and contours; however, the sides may have differing size and dimensions and contours.

A plurality of colors can be used. This provides the user with an easy means of distinguishing the different faces and different cleaning characteristics, for example.

The grooves and notches 108 were continuous around the entire device, covering 360° and transversing four faces. In alternative embodiments, the cleaning device can include grooves and notches that are perpendicular to the grooves and notches shown in FIG. 13, thereby creating, for example a "checkered" pattern (see FIGS. 17-19, discussed below). In other embodiments, the grooves and notches do not circumvent the entire surface and all faces. The depicted cleaning device has six faces, some with differing characteristics and sizes. The differences permit flexibility in cleaning the various shapes, depths, surfaces, etc. that may need to be cleaned. The angled notches and sides of different lengths can permit the cleaning to be accomplished with the user exerting force and many different angles, for example.

Figure 14:
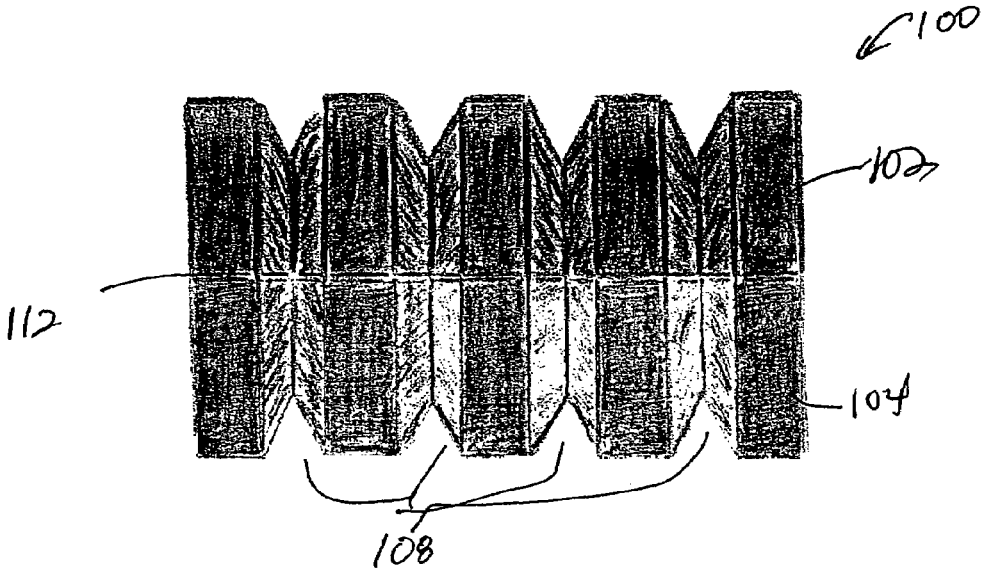
FIG. 14 illustrates an end view of the cleaning device of FIG. 13.
Figure 15:
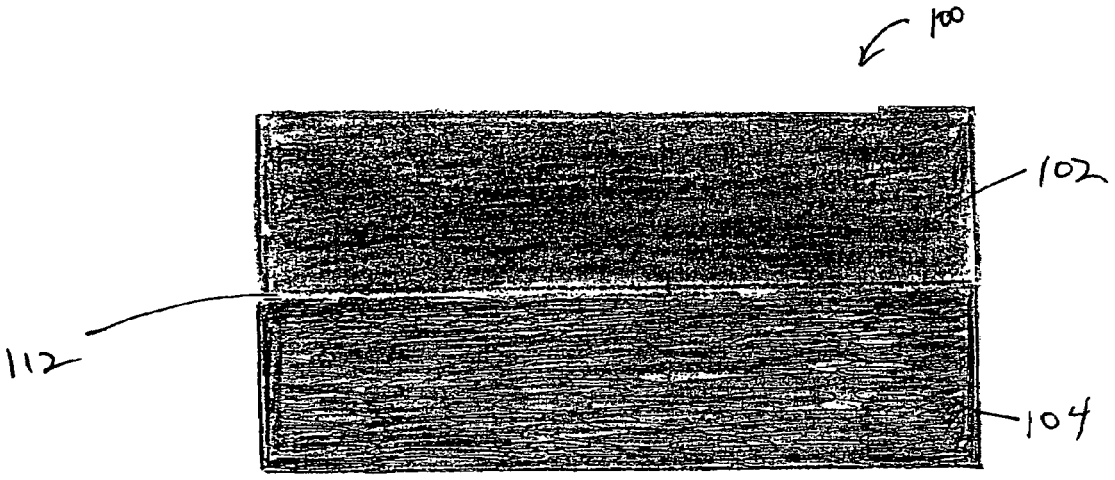
FIG. 15 illustrates a side view of the exemplary cleaning device of FIG. 13.
Figure 16A:
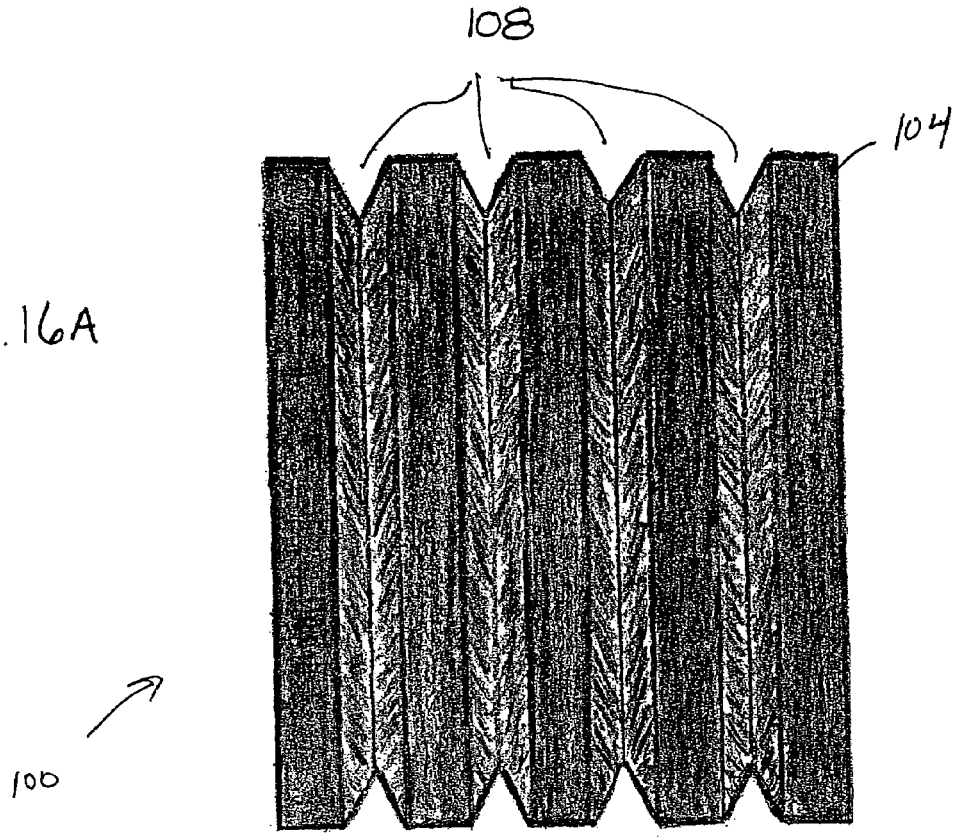
FIGS. 16A-B illustrate top and bottom views of the cleaning device of FIG. 13.
Figure 16B:
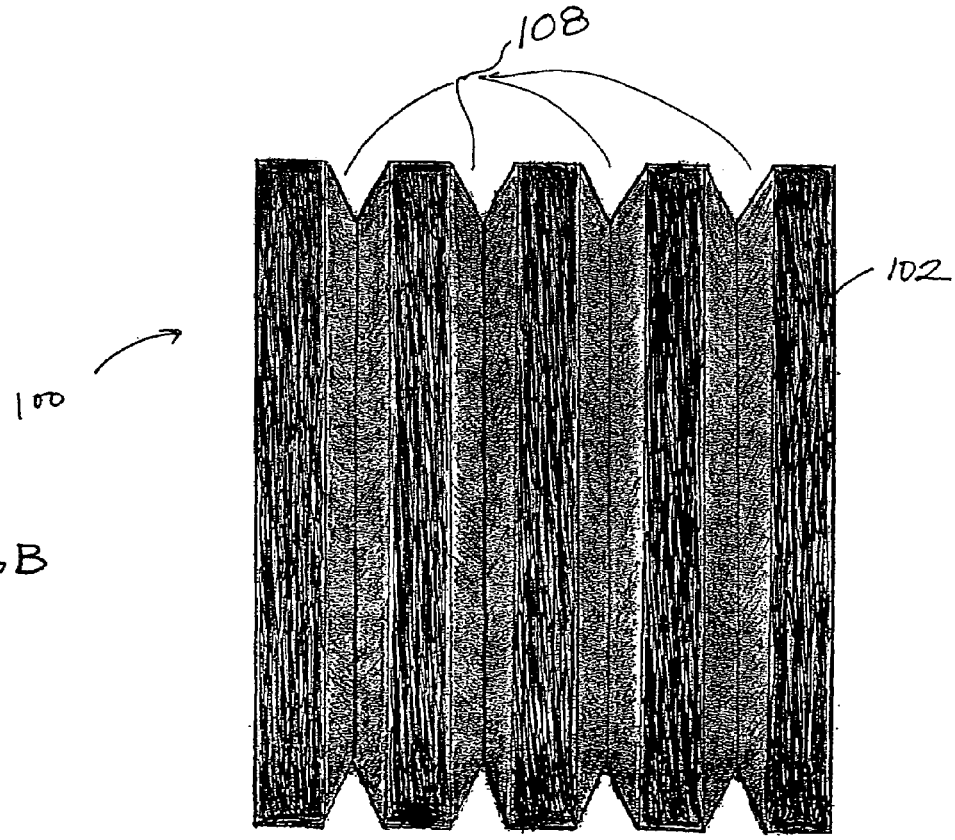

FIG. 14 illustrates an end view of the cleaning device. The grooves 108 run parallel to each other and continue onto the top and bottom sides. FIG. 15 illustrates a side view of the exemplary cleaning device. In the illustrated embodiment, the opposing end view and side view are also represented by the end view and side view illustrated in FIGS. 14 and 15. The sides did not include grooves and notches but were flat. In other embodiments the sides could include grooves and notches. In this case, not having grooves and notches provided different flexibility in having flat sides that can be useful for cleaning some parts of the cooking devices. FIGS. 16A and B illustrates the top and bottom of the cleaning device. FIG. 16A illustrates the synthetic foam top while FIG. 16B illustrates the polyester bottom.

Thus, FIGS. 13-16 illustrate a rectangular cleaning device 100 with four sides that have grooves and notches 108 that run parallel to each other and completely transverse the four sides, each groove being continuous. The user can efficiently clean with flexibility of having different faces to choose from with different sizes, etc. For cleaning many cooking devices, the polyester portion is comparatively more abrasive than the synthetic foam. The synthetic foam generally provides greater absorption for most materials such as liquids. The two sides can have different capabilities in terms of being able to absorb or capture food and waste material from the cooking device. In this case, the device has two halves of equal size. In other embodiments, the ratios can be significantly different, for example with one material covering about 1, 10, 20, 30, 40, 50, 60, 66, 75, 85, 90, 95, 97, 98, and 99 percent, while the other parts of the device will comprise the remaining percentage of area. Any combination can be used and there may be more than two different materials used, for example 3, 4, 5, or more materials, where the total between the different sides equals 100%.

The grooves in this example are angled to meet at a point. In some embodiments such a design provides flexibility in that force can be applied, and the device can be positioned at different angles to reach different parts of the cooking device. In some embodiments the grooves are arched or rounded, in others the grooves can have three or more sides, for example.

Although the colors as discussed with reference to the upper and lower sides are blue and charcoal, different color schemes, combinations and designs can be used and are contemplated herein. The cleaning device can be included as part of kit, for example, along with a cleaning solution or spray, or any other accessory. In some embodiments, color of the materials can be indicative of a property of the cleaning device, such as the type of cleaning composition it contains, temperature sensitivity or resistance of the material, abrasiveness of the material, and the like.

The cleaning device was made by creating the two sides using specific tooling, and gluing the sides together.

EXAMPLE 5

Figure 17:
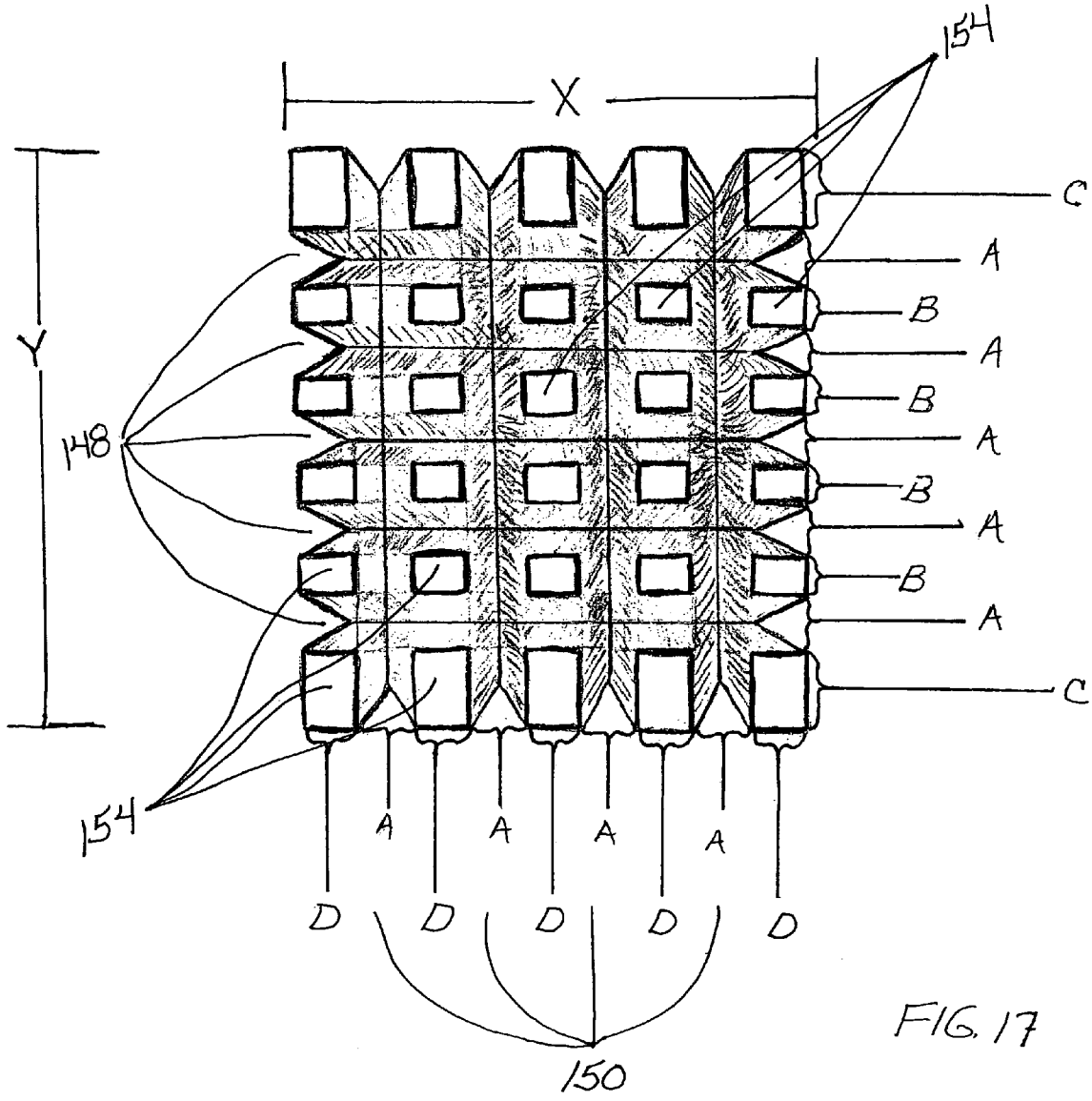
FIG. 17 illustrates a top view of an exemplary cleaning device.
Figure 18:
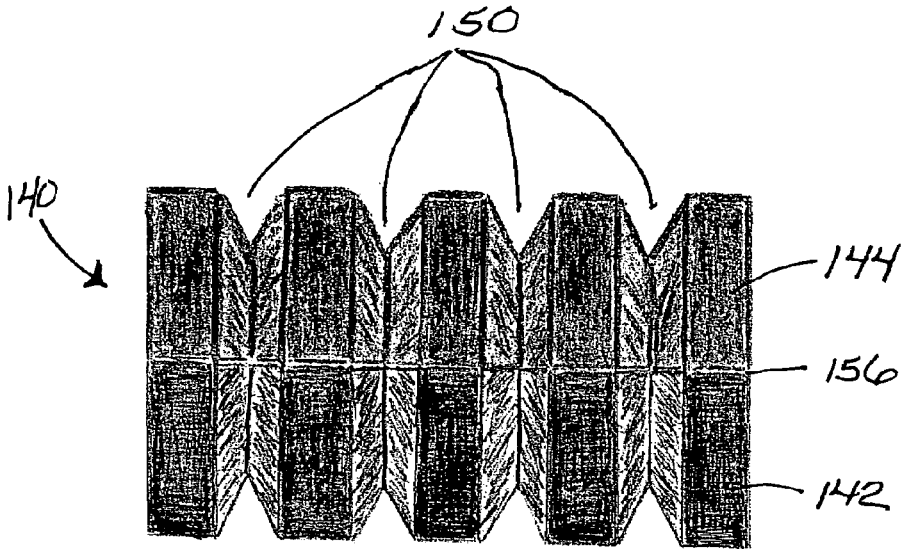
FIG. 18 illustrates an end view of the cleaning device of FIG. 17.
Figure 19:
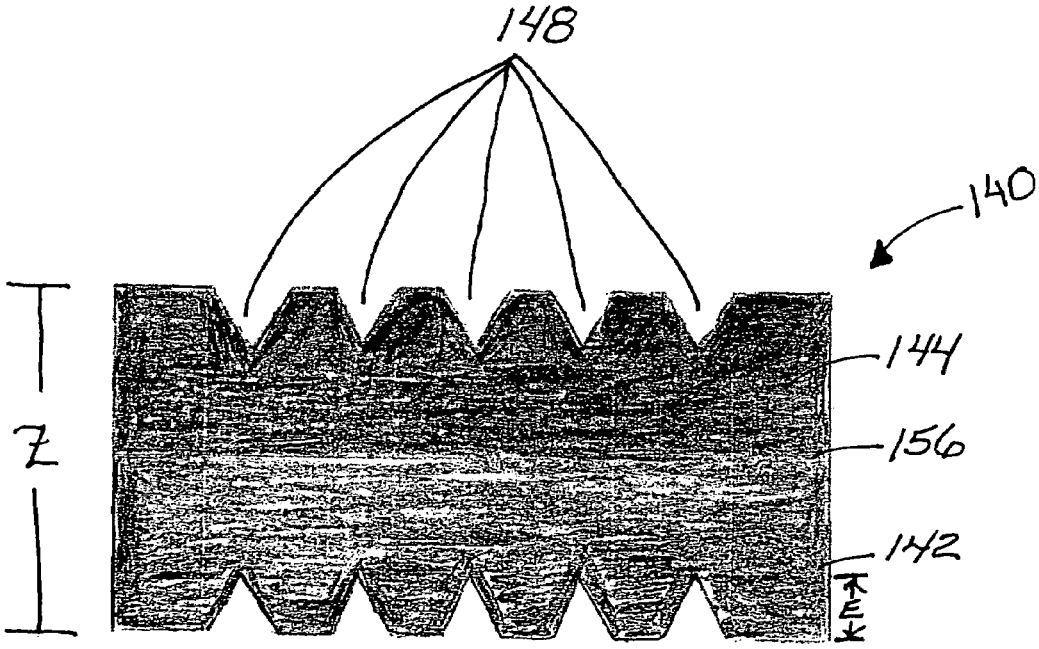
FIG. 19 illustrates a side view of the cleaning device of FIG. 17.

FIGS. 17-19 illustrate another exemplary cleaning device in several different views. FIG. 17 illustrates a top or bottom view of a cleaning device 140. In some embodiments, the difference between the top and bottom can be the use of different materials, different dimensions, or even have different designs (top as shown and bottom with only parallel channels and no perpendicular channels, for example). While in other embodiments, the top and bottom can be made of the same material and have the same dimensions or design. The device 140 also comprises a first plurality of continuous, parallel grooves and notches 148 and a second plurality of continuous, parallel grooves and notches 150. As illustrated in FIG. 17, the first plurality of grooves and notches 148 and second plurality of grooves 150 and notches form a generally "checkered pattern, resulting in cleaning surfaces 154.

FIG. 18 illustrates the front and rear side views. As shown in FIG. 18, the device 140 includes a lower side 142 and an upper side 144 joined by an adhesive 156. The cleaning device may be made of a plurality of materials, and in one preferred embodiment, the cleaning device is made of two different materials, as described above. Alternatively, the cleaning device may be made of a single material, in which case an adhesive would not be necessary.

FIG. 19 illustrates the side of the device 140. As shown in FIGS. 17 and 19, the device had a height "Y" of 2 inches, a length "Z" of 4 inches, and a width "X" of 3⅜ inches. FIG. 17 shows that the notches/grooves 148 were ⅜ of an inch at the widest part "A" with ¼ of an inch gaps in between "B", and with a ⅝ of an inch separation from the end of the device "C" along the length "Y". FIG. 17 also shows that notches and grooves 150 were ⅜ of an inch at the widest part "A" with ⅜ of an inch gaps in between "D". FIG. 19 also illustrates that the notches and grooves 148, 150 may have a depth "E" of up to about ½ of an inch. The dimensions above are exemplary and can be increased or decreased depending upon the cooking device that is to be cleaned. The particular dimensions used may depend on the particular cooking device with which the device 140 is to be used. For example, each device 140 may be designed for a particular manufacturer's cooking device. Alternatively, the cleaning device 140 may be designed to conform to most manufacturer's cooking devices.

A plurality of colors can be used. This provides the user with an easy means of distinguishing the different faces and different cleaning characteristics, for example.

The grooves and notches 150 were continuous around the entire device, covering 360° and transversing four faces. The grooves and notches were not continuous around the entire device, only transversing the top and bottom surfaces. However, it is envisioned in some embodiments that the grooves and notches are continuous around the entire device, covering 360° and transversing four faces. Accordingly, in some embodiments, only the top and bottom of the cleaning device have the checkered pattern, the ends have ridges, and the sides have flat surfaces. In other embodiments, four surfaces could have a checkered pattern, and 2 surfaces could have a ridged or flat surface. In still other embodiments, all 6 surfaces of a rectangular cleaning device could have a checkered pattern.

EXAMPLE 6

As described above with reference to FIGS. 1-19, exemplary dimensions have been provided for the embodiments of cleaning devices. In some embodiments, the width X of the cleaning devices described above may be any value or range of values from about 3 inches to 6 inches, the height Y of the cleaning device may be any value or range of values from about 3 inches to 6 inches, the length Z of the cleaning device may be any value or range of values from about 4 inches to 8 inches. The actual dimensions may also be higher or lower than the dimensions indicated above. In some embodiments wherein the height Y of the cleaning device is from about 3 to about 4 inches, the depth C of the grooves and notches is about ½ of an inch. In some embodiments, wherein the height Y of the cleaning device is from about 4 to about 5 inches, the depth C of the grooves and notches. is about ¾ of an inch. In some embodiments, wherein the height Y of the cleaning device is from about 5 to about 6 inches, the depth C of the grooves and notches is about 1 inch.

Cleaning devices having these dimensions may also be used for large outdoor grills, appliances, automobiles, tiles and the like. In some embodiments, sturdy materials may be required to adequately clean the surfaces to be cleaned. For example, a metallic-based material may be required to clean outdoor grills and barbecues. Other exemplary materials include polyester, foam, silicon extracts and extrusions, mesh, metallic-based materials, and the like.

Figure 20:
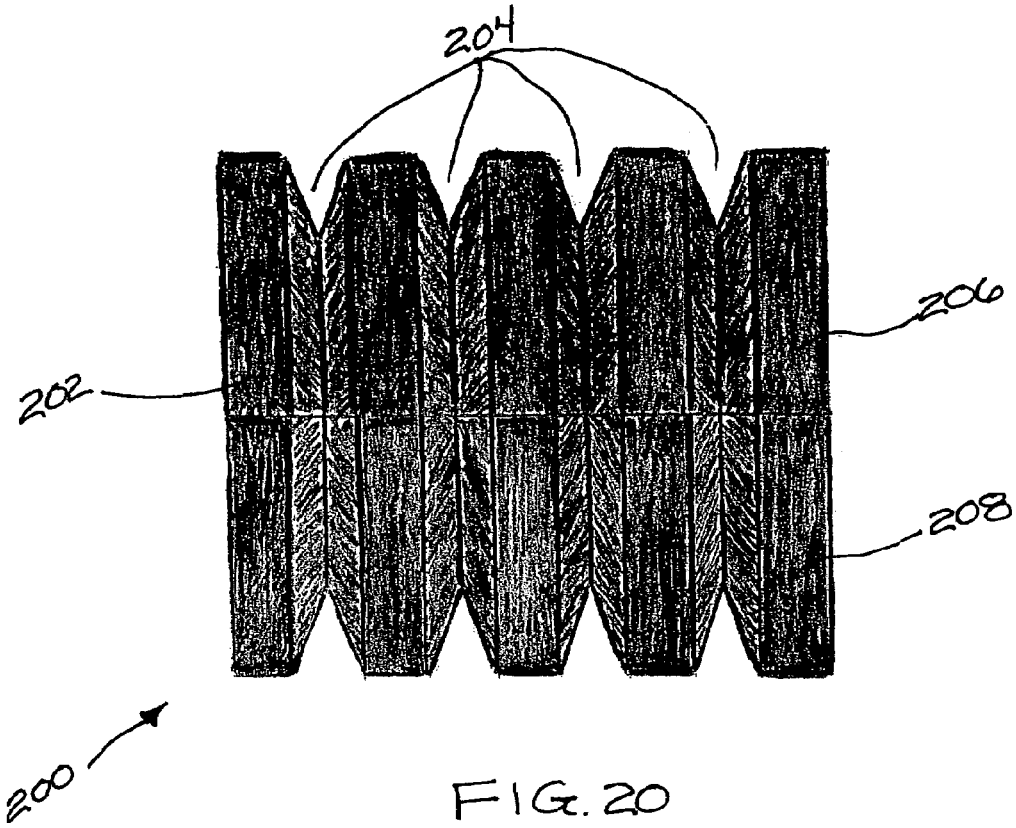
FIG. 20 illustrates a front side view of a larger cleaning device having a greater height and a greater depth of grooves or channels.
Figure 21:
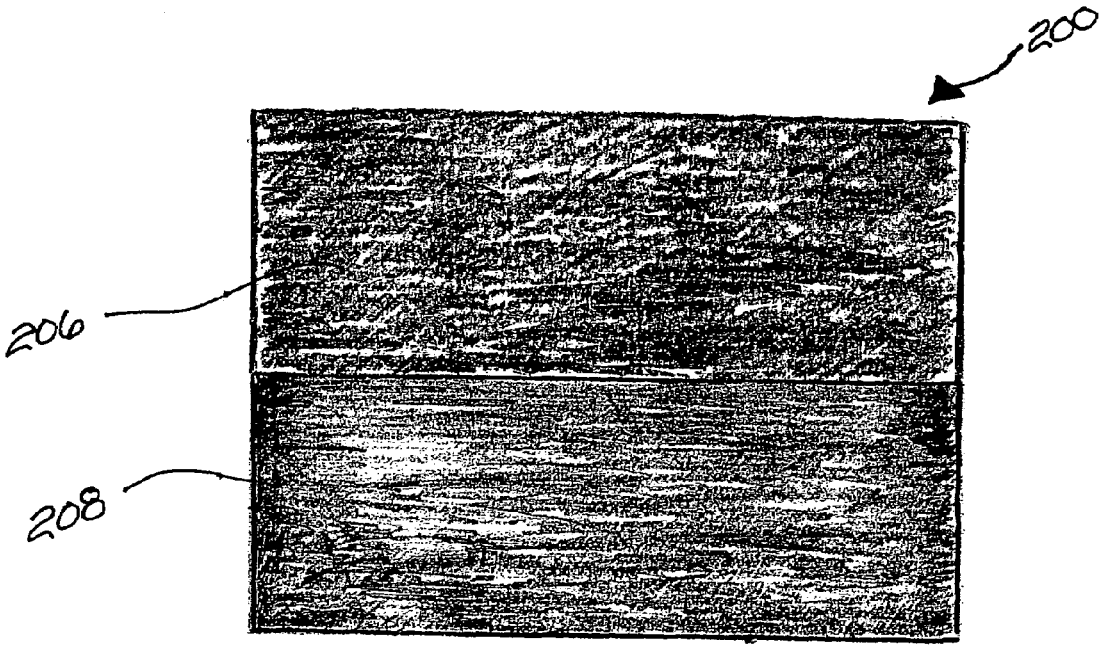
FIG. 21 illustrates a side view of a larger cleaning device having a greater height.
Figure 22:
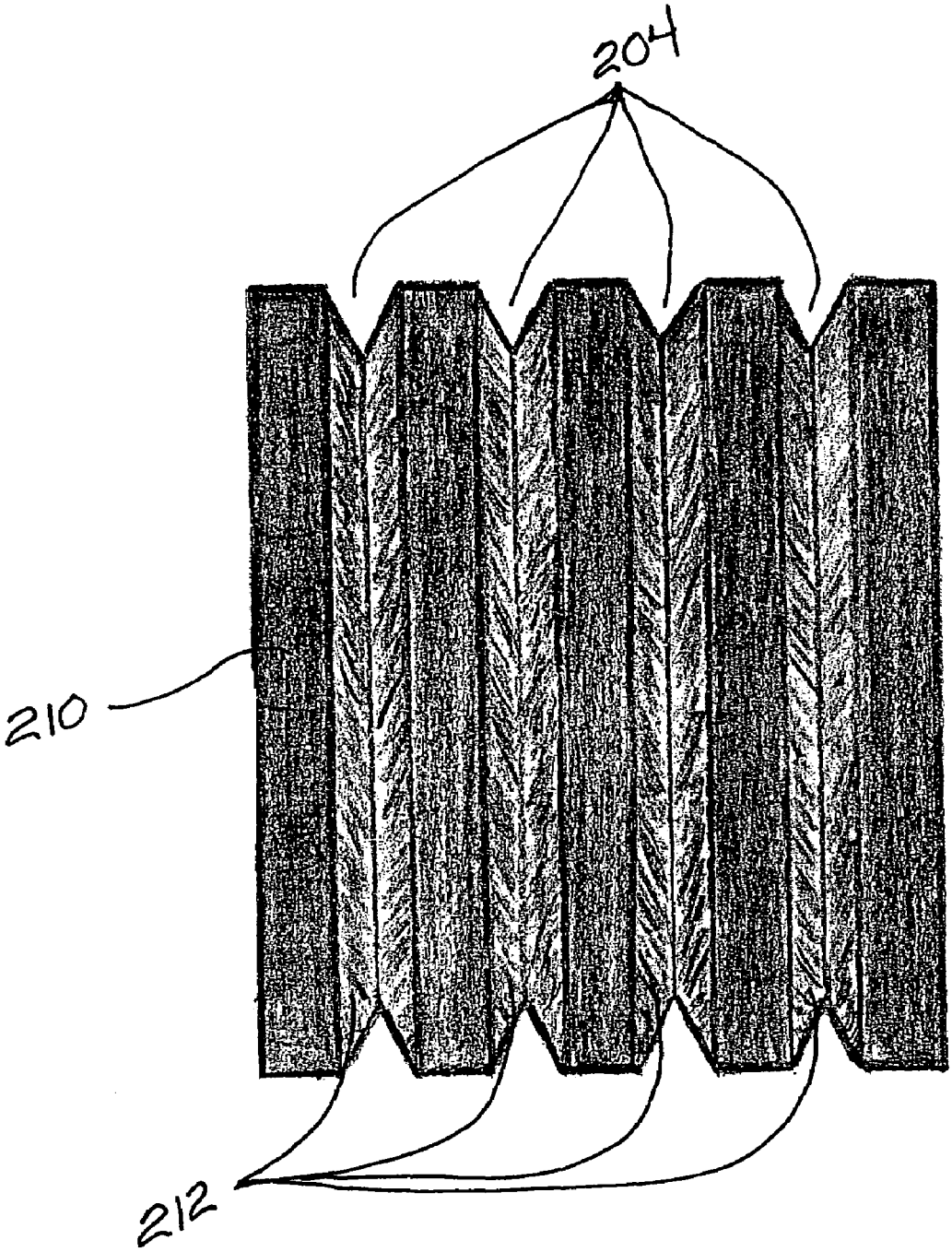
FIG. 22 illustrates a top view of a larger cleaning device having a greater depth of grooves or channels.

Exemplary cleaning devices with larger dimensions are set forth in FIGS. 20-22. As shown in FIG. 20, the exemplary cleaning device 200 has front side 202 with parallel channels 204 traversing the face, as shown the channels are oriented vertically. The device has shown is made of two different materials 206, 208, the top material 206 is a synthetic foam, and the bottom material 208 a polyester. The two materials are attached together using an adhesive. In other embodiments, the cleaning device can include one material in one piece, in which case, no adhesive would be necessary. FIG. 21 illustrates a side view of the cleaning device 200. The side view shows the top synthetic foam portion 206, and the lower polyester portion 208. FIG. 22 illustrates a top view of the larger cleaning device 200. As shown in FIG. 22, the cleaning device includes a top face 210, and parallel channels 212 traversing the face. The openings of the channels 204 as shown in FIG. 20 are also shown, which depicts the continuous nature of the channels in this particular embodiment, which channels completely traverse four sides of the cleaning device. The channels as shown have a depth of ½ inch, although the depths and widths can be modified to conform to the particular device that is to be cleaned. Although FIG. 22 as described is a top view, it is also representative of the bottom view for the exemplary larger device.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A cleaning device comprising:

at least a first cleaning face, wherein the first cleaning face comprises a first plurality of parallel ridges that run the length of the first cleaning face;

at least a second cleaning face, wherein the second cleaning face comprises a second plurality of parallel ridges that run the length of the second cleaning face;

at least a third cleaning face, wherein the third cleaning face comprises a third plurality of parallel ridges that run the length of the third cleaning face; and at least a fourth cleaning face, wherein the fourth cleaning face comprises a fourth plurality of parallel ridges that run the length of the fourth cleaning face, wherein the cleaning device comprises at least two materials selected from the group consisting of foam, rubber, silicon, a synthetic material, polyester, cellulose, natural sponge, synthetic sponge, plastic, mesh, fiber, nylon, natural bristles, synthetic bristles, an organic polymer, an extrusion, and combinations thereof, and wherein the first, second, third and fourth pluralities of parallel ridges form a plurality of continuous ridges that circumscribe each of said four faces, and wherein the device is in the shape of a rectangular block and comprises ridges on the two largest faces of the device.

2. The cleaning device of claim 1, wherein the ridges are ⅜ of an inch wide, and are separated from one another by ⅜ of an inch.

3. The cleaning device of claim 1, wherein at least two of the ridges are 4 inches long.

4. The device of claim 1, wherein the cleaning device comprises at least one absorbent material.

5. The device of claim 1, wherein the cleaning device comprises at least one material that is resistant to heat.

6. The device of claim 1, wherein the cleaning device comprises at least one material that is non-abrasive.

7. The cleaning device of claim 1, wherein the cleaning device comprises a non-abrasive material and an absorbent material.

8. The cleaning device of claim 1, wherein the cleaning device comprises a first non-abrasive material and a second non-abrasive material.

9. The cleaning device of claim 8, wherein the first non-abrasive material is relatively less abrasive than the second non-abrasive material.

10. The cleaning device of claim 1, wherein the cleaning device comprises a non-abrasive material and a material that is resistant to heat.

11. The cleaning device of claim 1, wherein at least one material comprises a foam.

12. The cleaning device of claim 1, wherein at least one material comprises a polyester.

13. The cleaning device of claim 1, wherein at least one material comprises a synthetic material.

14. The cleaning device of claim 1, wherein at least one material comprises a synthetic sponge.

15. The cleaning device of claim 1, wherein at least one material comprises a foam and at least one material comprises a polyester.

16. The cleaning device of claim 1, wherein at least two of said first, second, third and fourth faces each individually has a surface area that is larger than or equal to the individual surface area of every other face of said cleaning device.

17. The cleaning device of claim 16, wherein at least one material comprises a polyester and at least one material comprises a synthetic sponge.

18. The cleaning device of claim 1, wherein at least one material comprises a polyester and at least one material comprises a synthetic sponge.

19. The cleaning device of claim 1, further comprising a plurality of parallel grooves on said first, second, third and fourth faces.

20. The cleaning device of claim 19, wherein at least two of said first, second, third and fourth faces each individually has a surface area that is larger than or equal to the individual surface area of every other face of said cleaning device.

21. A method of cleaning a cooking surface comprising contacting a cleaning device according to claim 1 with a cooking surface.

* * * * *